US008745782B2

(12) United States Patent
Bernat

(10) Patent No.: US 8,745,782 B2
(45) Date of Patent: Jun. 10, 2014

(54) PORTABLE HAMMOCK

(76) Inventor: Jeffrey Alan Bernat, Minneapolis, MN (US)

( * ) Notice: Subject to any disclaimer, the term of this patent is extended or adjusted under 35 U.S.C. 154(b) by 336 days.

(21) Appl. No.: 13/072,659

(22) Filed: Mar. 25, 2011

(65) Prior Publication Data

US 2011/0231992 A1 Sep. 29, 2011

Related U.S. Application Data

(60) Provisional application No. 61/317,384, filed on Mar. 25, 2010.

(51) Int. Cl.
*A47C 17/64* (2006.01)
*A47C 17/72* (2006.01)

(52) U.S. Cl.
USPC ..... 5/115; 5/110; 5/111; 5/112; 5/113; 5/116

(58) Field of Classification Search
USPC ..... 5/110–117, 625–629
See application file for complete search history.

(56) References Cited

U.S. PATENT DOCUMENTS

| | | | | | |
|---|---|---|---|---|---|
| 803,779 | A | * | 11/1905 | Parlee | 5/115 |
| 1,151,495 | A | * | 8/1915 | Menten | 5/122 |
| 1,176,963 | A | * | 3/1916 | Howell | 297/106 |
| 1,224,782 | A | * | 5/1917 | Pedersen | 5/115 |
| 1,312,299 | A | * | 8/1919 | Almen | 5/115 |
| 1,518,386 | A | * | 12/1924 | Brower | 5/117 |
| 1,529,077 | A | | 3/1925 | Matsushita | |
| 1,758,721 | A | * | 5/1930 | Swartz et al. | 297/106 |
| 2,011,874 | A | * | 8/1935 | Ricketts | 297/23 |
| 2,579,263 | A | * | 12/1951 | Kroha | 5/115 |
| 3,278,953 | A | | 10/1966 | Willis | |
| 3,593,352 | A | | 7/1971 | Britt | |
| 3,757,360 | A | | 9/1973 | Wescott | |
| 3,848,279 | A | | 11/1974 | Ipsen, Jr. | |
| 3,956,781 | A | * | 5/1976 | Reemelin | 5/114 |
| 4,234,005 | A | | 11/1980 | Taylor, III | |
| 4,742,587 | A | * | 5/1988 | Dove | 5/627 |
| 4,885,812 | A | | 12/1989 | Lindner et al. | |
| 4,914,768 | A | * | 4/1990 | Howard | 5/113 |
| 4,984,768 | A | | 1/1991 | Kolber et al. | |
| 5,016,792 | A | | 5/1991 | Jay | |
| 5,109,556 | A | * | 5/1992 | Cook | 5/110 |
| 5,179,746 | A | * | 1/1993 | Rogers | 5/625 |
| 5,489,052 | A | | 2/1996 | Blood, Jr. | |
| D411,387 | S | | 6/1999 | Zheng | |
| 5,983,422 | A | | 11/1999 | Bayless | |
| 6,134,727 | A | | 10/2000 | Hwang et al. | |
| 6,493,890 | B2 | * | 12/2002 | Smeed | 5/503.1 |
| 6,711,761 | B2 | * | 3/2004 | Choi | 5/114 |
| 6,763,534 | B2 | | 7/2004 | Hwang et al. | |
| 6,764,132 | B1 | | 7/2004 | Gaertner | |
| 6,938,288 | B2 | * | 9/2005 | Hunter et al. | 5/114 |
| 6,966,084 | B2 | * | 11/2005 | Le Gette et al. | 5/129 |

(Continued)

*Primary Examiner* — William Kelleher
*Assistant Examiner* — David R Hare
(74) *Attorney, Agent, or Firm* — Underwood & Associates, LLC

(57) ABSTRACT

A portable, reversibly-extensible hammock has a foldable structure for supporting a substantially planar support surface. The hammock can be folded for transportation or storage, and can be shifted to an extended configuration to create a rectangular structure similar to a cot or hammock frame. A dual-purpose tensioning strap joins the support surface to the foldable structure and increases the structural integrity of the structure by urging top portions of leg members toward a center point of the rectangular structure.

30 Claims, 18 Drawing Sheets

(56) References Cited

U.S. PATENT DOCUMENTS

| | | | | |
|---|---|---|---|---|
| 7,100,221 | B1 | 9/2006 | Twigg | |
| 7,243,383 | B1 | 7/2007 | Hennessy et al. | |
| 7,406,726 | B2 * | 8/2008 | Deng | 5/127 |
| 7,566,095 | B2 | 7/2009 | Reeb et al. | |
| 8,065,760 | B2 * | 11/2011 | Brune | 5/111 |
| 2003/0080592 | A1 | 5/2003 | Isom et al. | |
| 2006/0150325 | A1 | 7/2006 | Zheng | |
| 2009/0256401 | A1 | 10/2009 | Hensley | |

* cited by examiner

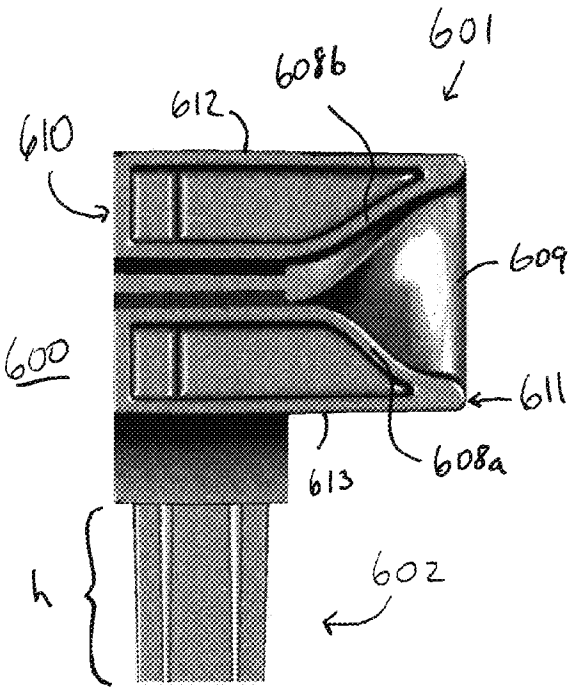
B
FIG 6
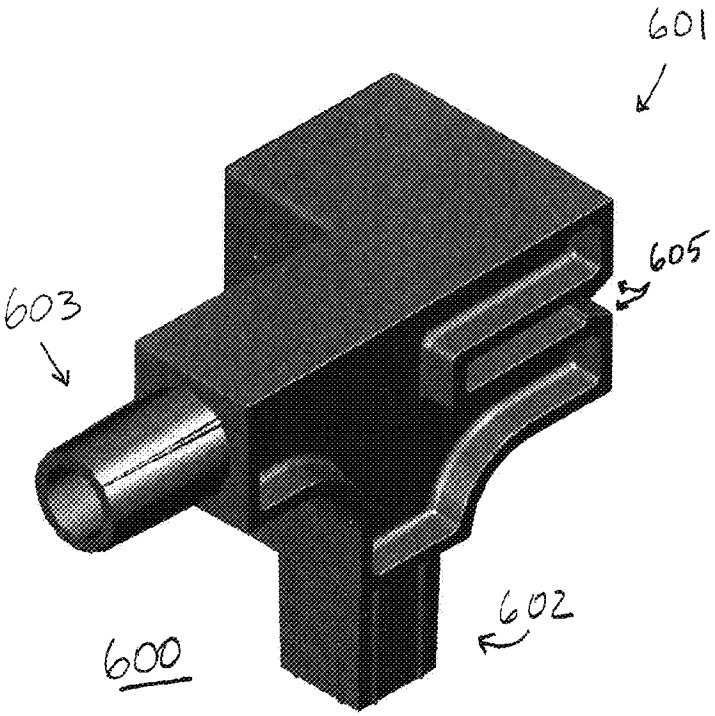
A

D1

PORTABLE HAMMOCK

CROSS REFERENCE TO RELATED APPLICATIONS

This application claims priority under 35 U.S.C. §119(e) of U.S. Provisional Patent Application No. 61/317,384, filed Mar. 25, 2010 by Jeffrey Alan Bernat, and entitled "Portable Hammock," which is incorporated herein by reference in its entirety for all purposes.

STATEMENT REGARDING FEDERALLY SPONSORED RESEARCH OR DEVELOPMENT

None.

TECHNICAL FIELD

This disclosure relates to reversibly-extensible frame systems capable of supporting a support surface in a cot-like configuration.

BACKGROUND

In general, some people enjoy being outdoors and engaging in outdoor activities such as camping and hiking. While spending time away from the conveniences of modern amenities can be rewarding, in some cases, people enjoy the ability to relax comfortably in an outdoor setting. Tents, campers, and other outdoor-living products allow people to engage with nature yet still provide some level of comfort or protection from weather and other factors. Portability of such devices can be desirable for the consumer, as, in some cases, it provides the ability to travel longer distances with a lesser weight burden on the carrier.

SUMMARY

In one general aspect, a collapsible, self-supporting hammock is disclosed. The hammock includes a reversibly extensible frame system capable of supporting a user's weight upon a substantially planar support surface, where the support surface is attached to the frame when the frame system is in an extended configuration. The support surface includes a tensioning strap that is capable of both providing structural integrity to the frame and concurrently providing tension of the planar support surface.

In one embodiment, the reversibly extensible frame system includes two or more leg pairs connected by one or more rotatably-coupled support member pairs that allow the frame to both compress into a minimum volume in a storage configuration and also extend into the extended configuration.

In one embodiment, a longitudinal stability of the frame is partially provided by locking the one or more support member pairs into an extended configuration. In a related embodiment, locking the one or more support member pairs into an extended configuration includes inserting a terminal end of a first support member of a support member pair into a shroud disposed on a first leg, and inserting a terminal end of a second support member into a shroud disposed on a second leg. In a related embodiment, each leg includes a joining member disposed on an end of the leg, wherein the joining member is configured to receive a portion of the tensioning strap and allow shifting of the tensioning strap therethrough. Furthermore, tightening the tensioning strap urges the leg ends toward one another against an urge-resistive bracing force provided by the support member pairs, thereby providing structural integrity to the frame.

In one embodiment, the second support member is part of a second support member pair.

In one embodiment, the joining member includes a rigid body having one or more protrusions configured to fit into a terminal portion of a frame member with a minimum of space therebetween. The joining member further includes a channel on a first face of the body which is configured to receive a portion of the tensioning strap. The joining member further includes a flared portion on a second face of the body, wherein the flared portion originates from the channel, and wherein the first and said second faces are orthogonal. In a related embodiment, the rigid body includes a first protrusion configured to be inserted into a leg of the frame and a second protrusion configured to be inserted into a terminal portion of a cross-brace that spans two or more legs of the frame.

In one embodiment, the hammock further includes a second substantially planar support surface capable of supporting a portion of a user's weight. The second planar portion is attached to the first planar support surface at one end, and to a headrest frame at a second end. The headrest frame is rotatably coupled to a portion of the frame system. In a related embodiment, the headrest frame is rotatably coupled to a cross-brace that spans a first and a second leg of the frame system. In a related embodiment, a headrest tensioning strap is coupled at each end to the headrest frame and a cross-brace, respectively, wherein the cross-brace is a rigid member that spans a first and second leg of the frame system.

In one embodiment, the planar support surface includes one or more mechanisms for attaching one or more accessory (ies), or a second collapsible, self-supporting hammock thereto. In a related embodiment, the accessory(ies) is one or more of: fishing or hunting accessories, floatation devices, shades, netting, beverage holders, pockets, anchors, pillows, or storage containers.

In one embodiment, a first frame leg comprises a jacket for coupling one of the rotatably-coupled supports to the first leg. The jacket includes a rigid body having one or more bores for inserting a one or more attachment mechanisms therethrough and into the leg to attach the jacket to the leg. The jacket further includes at least a partial shroud extending from the rigid body at an angle that allows an end portion of a first support member of the rotatably-coupled support to be inserted therein when the frame is in an extended configuration. At least one of the attachment mechanisms provides for attaching a second support member of the rotatably-coupled support to the jacket. In a related embodiment, the hammock further includes a column-shaped stabilizing body that protrudes from the rigid body and is disposed within the shroud. In this embodiment the stabilizing body is sized and configured to be inserted into the end portion of the first support member. The stabilizing body protrudes from the rigid body at substantially the same angle as the shroud.

In one general aspect, a portable cot is disclosed. The portable cot includes a reversibly extensible frame system for supporting a fabric thereon in a cot-like configuration. The frame system includes one or more rotatably-coupled x-shaped frame support members attached to, and separately spanning from first to second, and third to fourth legs, and one or more rigid cross-braces attached to, and separately spanning from the first to the third leg, and from the second to the fourth leg to provide a semi-rigid framework having a substantially rectangular shape. The fabric further includes a tensioning strap that allows a user to urge an end of the first, the second, the third, and the fourth legs together against a resistive force provided by the semi-rigid framework, which creates a substantially rigid framework and a resting surface capable of being used as a cot.

In one embodiment, the portable cot further includes a shroud on each of the first, second, third, and fourth legs that is configured to allow manual insertion and removal of an end of the x-shaped frame support member and provide connection to the leg without use of other attachment mechanisms.

In one embodiment, the portable cot further includes straps attached to the frame system or the fabric, or both, to allow the portable cot to be worn as a backpack.

In one embodiment the portable cot further includes means for attaching accessory items or attaching two or more portable cots in a tandem configuration.

In one general aspect, a portable hammock is disclosed. The portable hammock includes a substantially rectangular-shaped reversibly-extensible support frame that includes a substantially planar head frame and a substantially planar foot frame. The head frame and the foot frame include two legs coupled by one or more rigid cross-braces. The head frame and the foot frame are joined by at least two x-shaped supports to form a substantially-rectangular frame shape. The x-shaped support includes at least two rigid support members rotatably coupled near their longitudinal midpoints. The portable hammock further includes a first, substantially planar support surface capable of supporting a user's weight. The support surface is coupled to the reversibly-extensible support frame by a tensioning strap that is generally disposed about the perimeter of the support surface. The portable hammock further includes a backrest frame rotatably coupled to one of the head frame cross-braces. The portable hammock further includes a second, substantially planar support surface joined along one perimeter side to the first substantially planar support surface, and along a second perimeter side to the backrest frame. The tensioning strap runs through a joining member disposed on a top portion of each of the legs; providing tension to the tensioning strap causes each of the top portions of each leg to shift toward a midpoint of the substantially-rectangular frame shape when the portable hammock is in an extended configuration.

A portable hammock of the type described herein can be longitudinally extensible, e.g., fold into a minimum-volume configuration that allows transport as a backpack on a wearer's back; or extend into a deployed configuration, where a fabric support surface supports a user's weight like a cot or hammock. In some embodiments, a portable hammock includes a reversibly reclinable backrest body wherein a structural component of the backrest body is formed of fabric. In some embodiments, a portable hammock includes accessory members for holding articles, such as fishing poles, beverage containers, sleeping materials (e.g., sleeping bags) and the many others. In some embodiments, a portable hammock includes tandem attachment members for securing two or more portable hammocks together, creating a larger resting area than that of a single portable hammock. Such a configuration can be used for sleeping, or resting with a partner.

Certain advantages of the systems and methods described herein include lightweight portability, simple methods for deploying and packaging, and the ability to accessorize a portable hammock, among others.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The details of one or more embodiments are set forth in the accompanying drawings and the description below. Other features, objects, and advantages will be apparent from the drawings and detailed description, and from the claims.

DESCRIPTION OF DRAWINGS

The present embodiments are illustrated by way of example and not limitations in the figures of the accompanying drawings in which scale is arbitrary, like references indicate similar elements, and in which.

DETAILED DESCRIPTION OF ILLUSTRATIVE EMBODIMENTS

In general, resting systems are described. The resting systems as described herein can be used when and where a person wishes to sit- or lie down, such as during camping, hiking, lounging, or other activities. The resting systems described herein provide advantages in portability, ease of use (i.e., deployment and packaging for transport), protection from sunlight, bugs, and other environmental factors, and a providing a full-size resting area capable of being stored in a highly compact configuration.

In general, in one embodiment, a hammock system is described. In general, the term "hammock," as used herein, is used to describe a system that includes a substantially planar support fabric supported by at least one structural member. In some embodiments, however, the support fabric can be draped, to form a non-planar support fabric. Terms similar to "hammock" as used herein include cots, portable beds, "lawn chairs," and the like. The hammock systems can be reversibly collapsible, in that the system can be selectively deployed from an open, extended configuration (in this case, a hammock structure capable of supporting weight) into a collapsed, transportable configuration occupying minimal volume, and vice-versa. In general, a reversibly collapsible hammock (hereinafter "hammock") can include, among many other features and alternatives: a reversibly-collapsible, lightweight support structure system of trusses and support members configured to support of a fabric for carrying a user's weight; integrated shoulder straps for personal transportation during, e.g., hiking; a fabric for supporting the user's weight while sitting, lying down, or in other positions; and a system of lightweight fabric structural members for supporting an adjustable back rest. Additionally, a hammock can include features for storing or supporting personal items such as beverages, and accessory items such as protective covers, umbrellas, mosquito netting, sleeping accessories (pillows, sheets, sleeping bags and the like), and other accoutrements.

Throughout the disclosure, it will be understood that the inventive subject matter is not limited in its application to the details of the particular arrangements shown, but is also capable of other arrangements. Similarly, those skilled in the mechanical arts will appreciate that the features described, and the terms used to describe them, can be exchanged for equivalent structures, terminology, and construction approaches that yield similar results or function. The terminology used herein is for the purpose of description and not of limitation.

Figure 1:
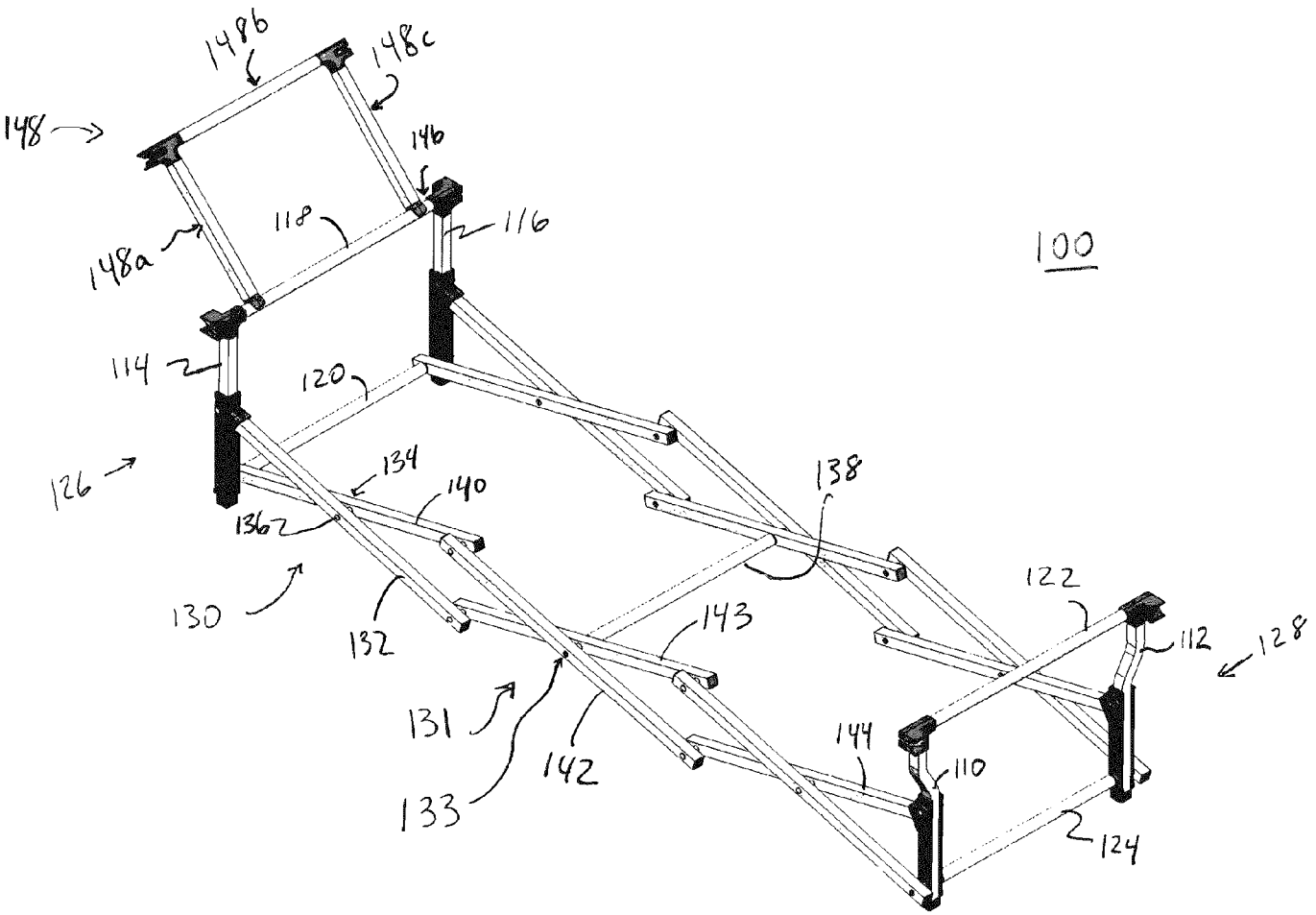
FIG. 1 is a perspective view of a collapsible hammock support structure, in the open configuration, according to one embodiment.
Figure 8A:
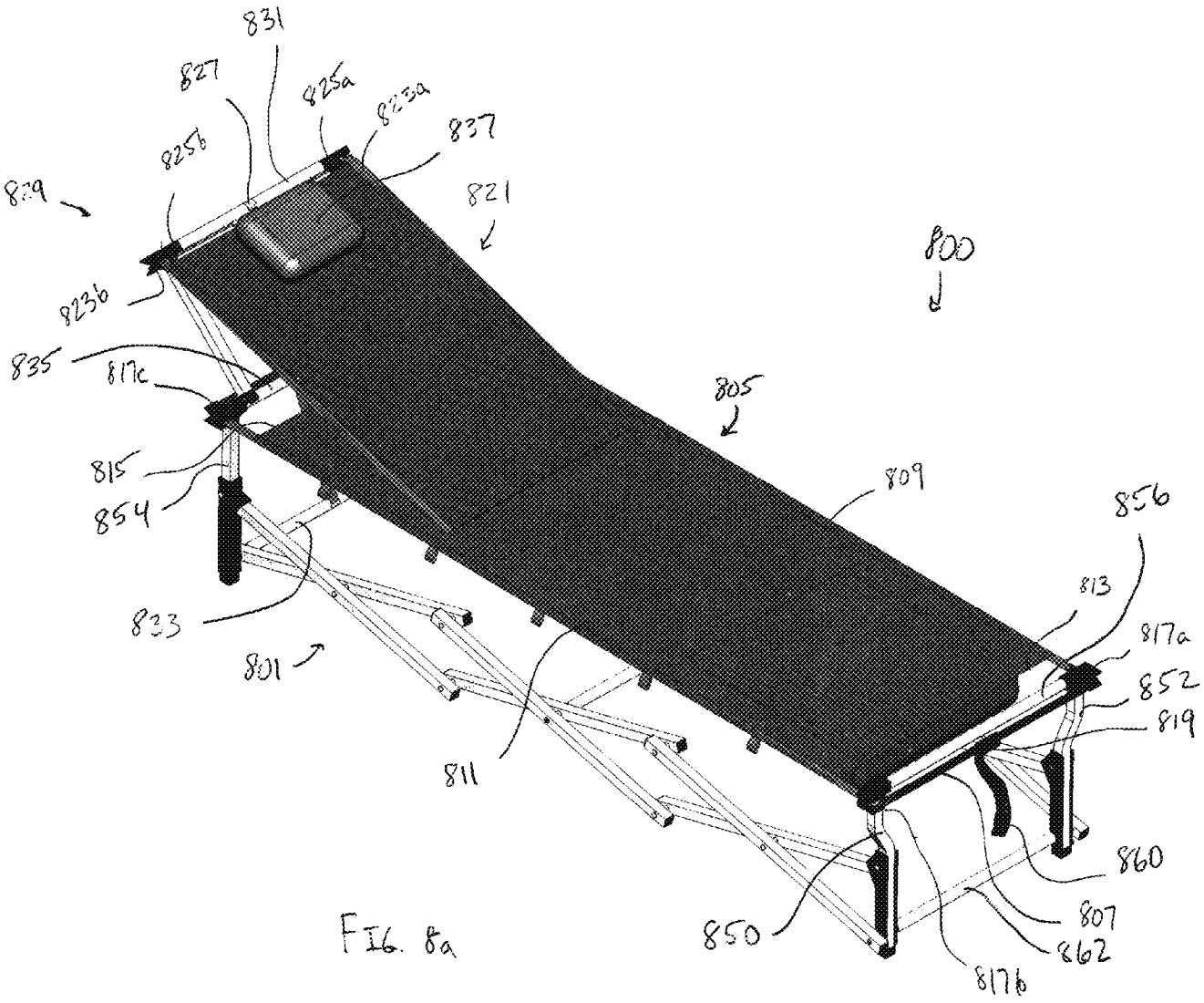
FIGS. 8A-8B show isometric and side views of a collapsible hammock, according to one embodiment.

Referring now to FIG. 1, a hammock support structure 100 is shown. A supporting fabric, upon which a user can rest, is not shown in FIG. 1 for clarity of structural components, however, one embodiment of a supporting fabric is illustrated in FIG. 8*a*. The support structure 100 can include a plurality of leg members that can each be formed of, e.g., tubular aluminum, steel, resilient plastics, or other materials capable of providing a structural framework. In the description that follows, the terms "left," "right," "upper," "lower," "front," and "back" as referred to in the figures is anecdotal, pertaining to the relationship of features or to the arrangement of elements so as to provide a reference point(s) for the reader. The structure 100 can include right legs 110, 112, and left legs 114, 116. Left legs 114, 116 can be directly or indirectly connected to an upper traversing cross brace 118 and a lower traversing cross brace 120. Likewise, right legs 110, 112 can be directly or indirectly connected to an upper traversing cross brace 122 and a lower traversing cross brace 124.

One or more X-shaped support member pairs 130 can couple the left legs 114, 116, to the right legs 110, 112, respectively. Each X-shaped support member 130 can include one or more elongate bars 132 pivotally coupled about a center point 134. The elongate bars can be coupled by methods known in the art, such as with a rivet 136, cotter, bolt, or similar article. One or more X-shaped support members 130 can be linked in series to create a longitudinally-extendable support structure 100 of varying length as illustrated in FIG. 1. For example, terminal portions of elongate bars 140 and 142 from neighboring X-shaped support members 130 and 131, respectively, can be pivotally coupled by a rivet 133. The number of X-shaped support members 130 can be selected to accommodate a desired length of the overall support structure 100. A traversing cross brace 138 can connect X-shaped support members 130 transversely, to provide additional stability of the support structure 100.

Figure 7:
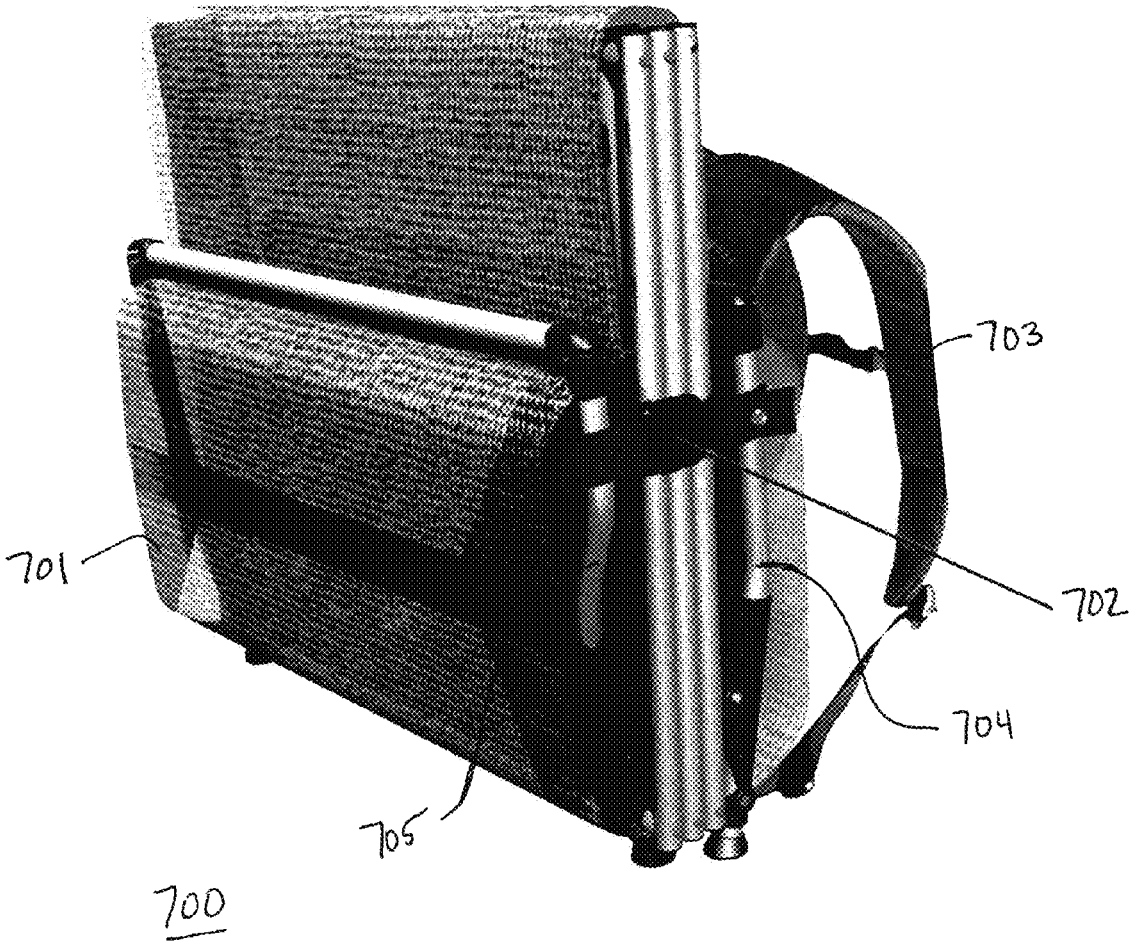
FIG. 7 shows a portable, collapsible hammock in a folded configuration, according to one embodiment.

X-shaped support members 130 can be optimally assembled such that parallel elongate bars on neighboring X-shaped support members 130, e.g., elongate bars 132 and 142, are brought to a substantially confronting relationship when the support structure 100 is in a folded configuration, such as the configuration shown in FIG. 7. Still referring to FIG. 1, it can be seen that elongate bars 140, 142, and 144, each corresponding to separate X-shaped support members, are positioned on the inner perimeter of the support structure 100. Thus, upon collapsing the structure 100 longitudinally (to a configuration shown, e.g., in FIG. 7), elongate bars 140, 142, 144 can be brought to a substantially confronting relationship. Such a configuration can allow the support structure 100 to be collapsed into a minimum volume, e.g., for transport.

A frame body 148 can include a plurality of interconnected support members 148*a-c* to provide a support structure for a fabric support that can be used, e.g., as a back rest. The frame body 148 can be pivotally coupled to an upper traversing cross brace 118, 122 by, e.g., a pair of C-clamps 146 integral with one or more of the support members 148*a*, 148*c*.

Figure 2:
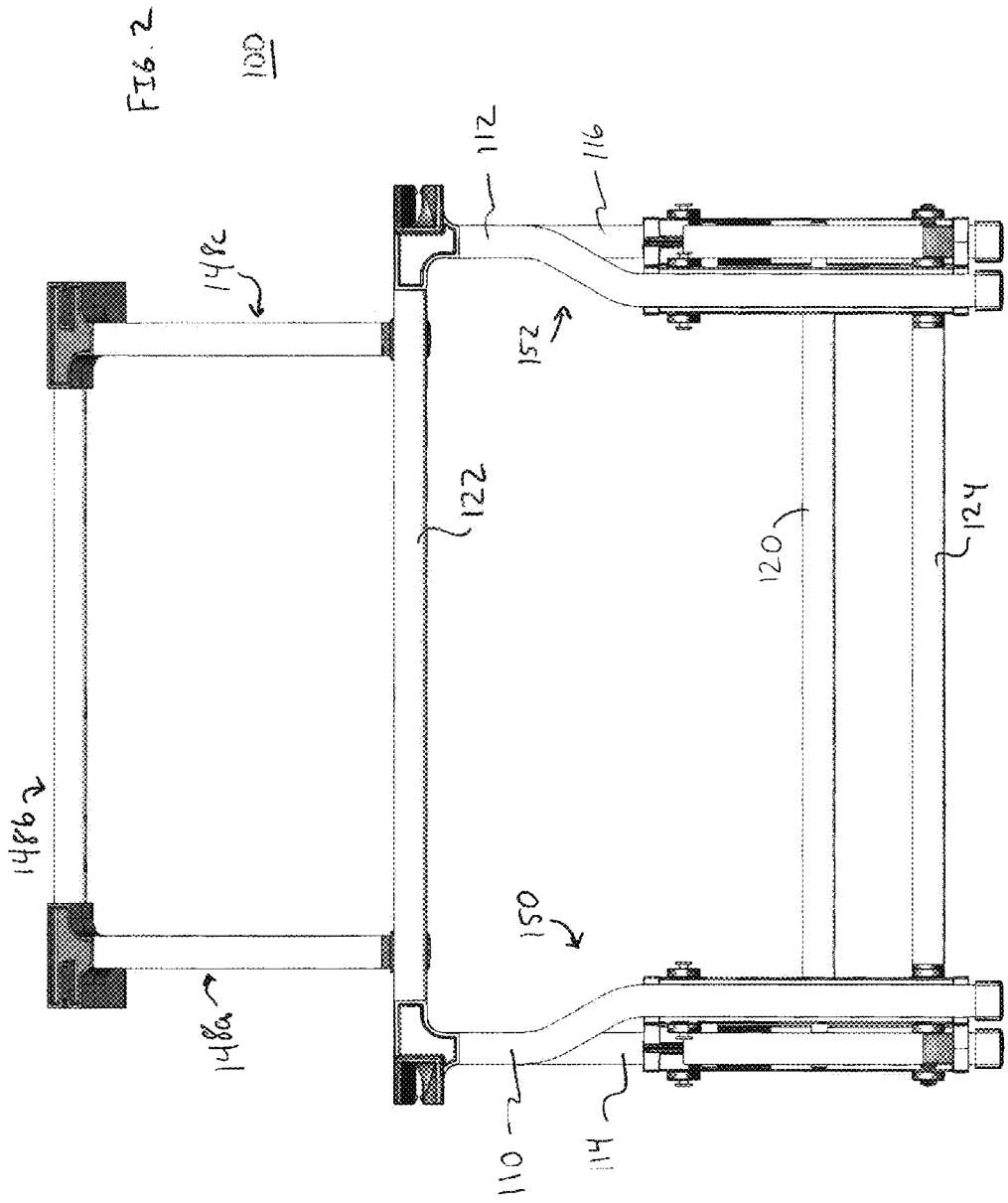
FIG. 2 is a frontal view of the collapsible hammock support structure shown in FIG. 1.
Figure 3:
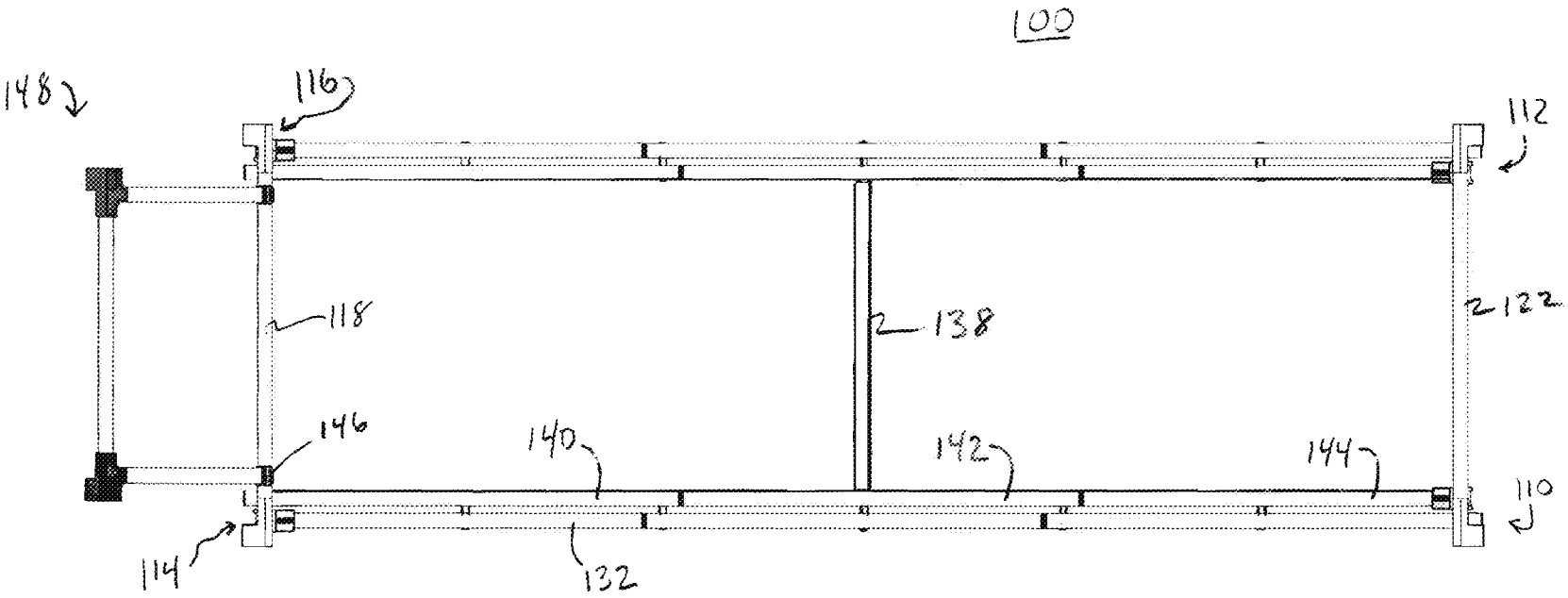
FIG. 3 is a top view of the collapsible hammock support structure shown in FIG. 1.

Referring now to FIGS. 2 and 3, a frontal view and a top view, respectively, of the collapsible hammock support structure 100 are shown. Lower portions of legs 110 and 112 are shifted toward each other via an "S" bend 150, 152, in each of the legs 110 and 112, respectively. Such is one of many possible configurations to accommodate one or more X-shaped support members 130 extending longitudinally and substantially perpendicular from a first pair of legs at one end of the support structure 100, e.g., legs 114 and 116, to a second pair of legs at a second end of the structure 100, e.g., legs 110, 112, so that the perimeter of the entire structure as viewed from the top is substantially rectangular in an open configuration (FIG. 3).

Figure 3A:
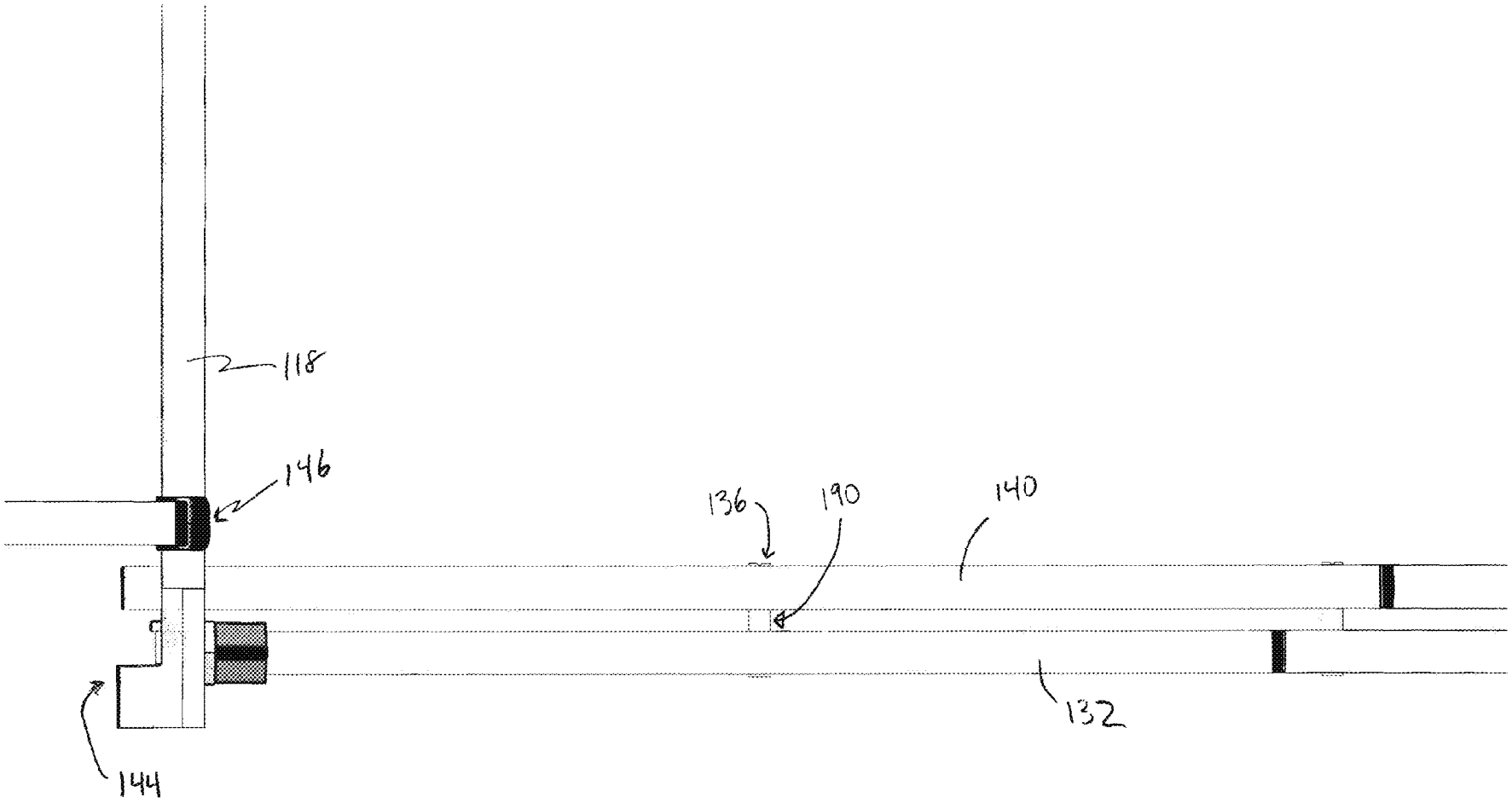
FIG. 3A is a magnified view of a portion of the collapsible hammock shown in FIG. 3.

Referring now to FIG. 3A, structural support members, e.g., support members 132 and 140, can be spaced from each other to reduce the likelihood of a user being pinched by the support members when folding or unfolding the support structure 100. In one embodiment, a hollow spacer 190 transversely separates elongate bars 132, 140 of the support structure 100 where the elongate bars are pivotally joined by rivet 136.

Figure 4:
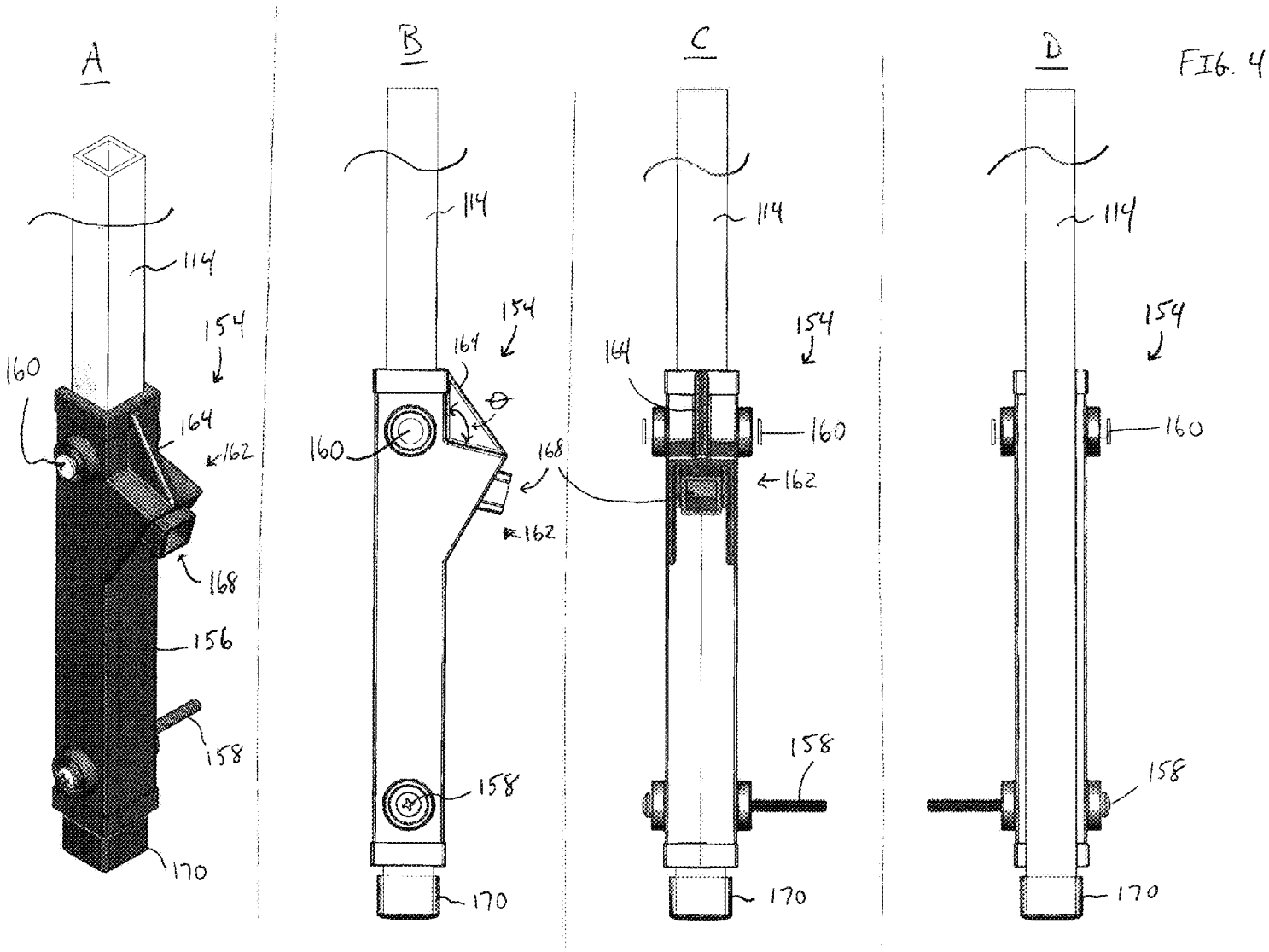
FIG. 4 shows four views of a leg assembly, according to one embodiment.

Referring now to FIG. 4, a leg assembly 154 is shown in isometric (A), right (B), front (C), and back views (D). Leg assembly 154 can be used to couple an X-shaped support member (e.g., X-shaped support member 130) to a leg (e.g., leg 114). The leg assembly 154 shown includes a body 156 that substantially wraps around three sides of the leg 114, although in some embodiments, the body 156 can have four sides and fit around a leg in a sleeve-like fashion. The body 156 can be sized to fit the leg snuggly, so as to minimize open space between the body 156 and the leg 114.

A lower bolt 158 extends through two opposing sides of the body 156 and the leg 114 to secure a lower portion of the leg assembly 154. In some embodiments, bolt 158 extends beyond the body 156 to provide an attachment point for an elongate bar (e.g., elongate bar 140) of an X-shaped support member 130. In such an embodiment, the elongate bar can be securely fastened to the leg assembly 154 and thereby the leg 114. A bolt 158 is one of many options for securely connecting an elongate bar of an X-shaped support member to a leg assembly 154. Other connection mechanisms such as pins, cotters, rivets and the like are known in the art and can be used as alternatives.

An upper bolt 160 extends through two sides of the body 156 and the leg 114 to secure an upper portion of the leg assembly 154. Similarly, other connecting means such as pins, cotter assemblies, rivets, and the like may be used to securely connect the upper portion of the leg assembly 154 to the leg 114.

Still referring to FIG. 4, a protuberant shroud 162 extends substantially perpendicularly from the long (vertical) axis of the body 156, and is shaped and sized to fittingly receive a terminal portion of an elongate bar, e.g., elongate bar 132. In this example, and consistent with FIGS. 1-3, the shroud 162 is configured to receive an end portion of a hollow, rectangular-tubular elongate bar. It will be understood, however, that the shroud can be sized and configured to receive an elongate bar having a circular cross-sectional end portion, or any other design.

Within the shroud 162, a column-shaped stabilizing body 168 protrudes from the leg assembly body 156. In this embodiment, the stabilizing body 168 is sized and configured to plug into an end portion of a hollow, rectangular-tubular elongate bar to minimize the likelihood of the elongate bar unintentionally shifting out of the shroud 162. Again, the stabilizing body 168 can be designed to fit into an aperture of any type of elongate bar, e.g., a hollow, tubular elongate arm. The shroud 162 extends from the assembly body 156 at a slight downward angle θ as indicated in view B which can provide additional stabilizing force as described below; a buttress member 164 extends from the assembly body 156 to a top portion of the shroud 162 to provide structural reinforcement.

Figure 4A:
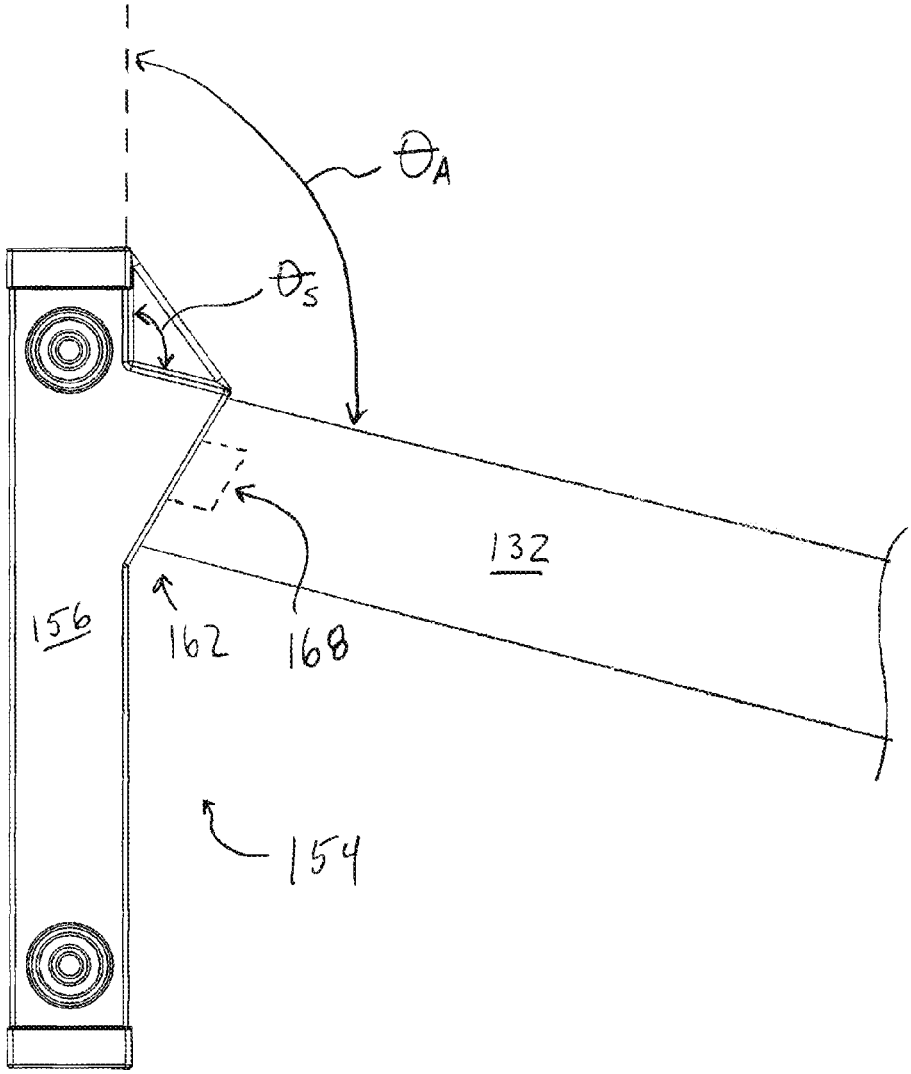
FIG. 4A shows a leg assembly, according to one embodiment.

Referring now to FIG. 4A, shroud 162 and the stabilizing body 168, alone or in combination, can be configured stay a terminal portion of an elongate arm, e.g., elongate arm 132, when the support structure 100 is in an open configuration, such as that shown in FIG. 1. In general, the shroud 162 and stabilizing body 168 are angled downward slightly at an angle θ, so that the angle $\theta_S$ of the shroud 162 and the angle $\theta_A$ of the elongate arm 132 are substantially equal when the support structure 100 is in an open configuration. Such a configuration can provide resistance to shear between a terminal portion of elongate bar 132 and the leg assembly 154, and also provide an easy, intuitive fit for the user when deploying the hammock from a folded configuration.

Figure 5:
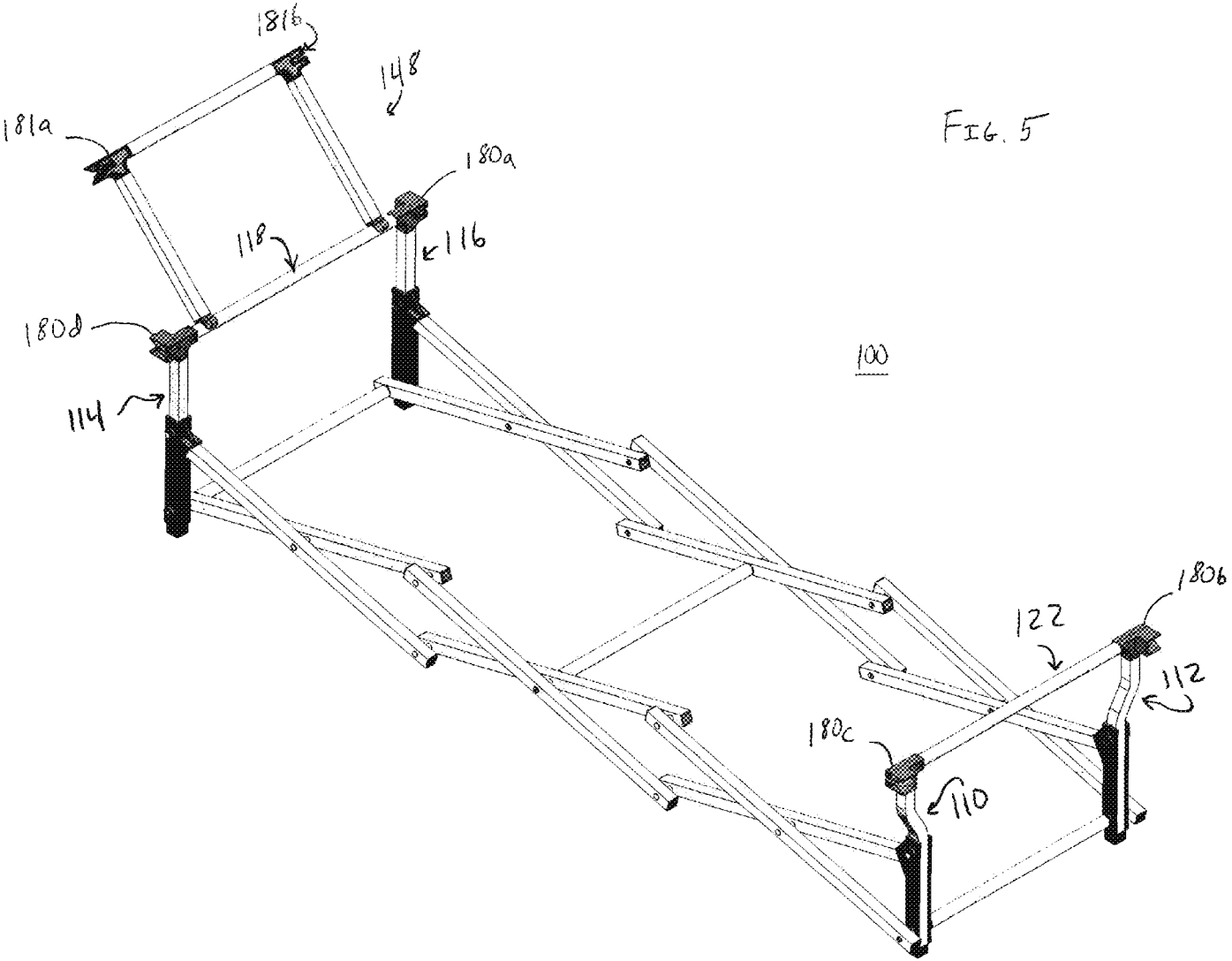
FIG. 5 shows a support structure for a portable, collapsible hammock, according to one embodiment.

Referring now to FIG. 5, any of the elongate bars that together make up the support structure 100 members can be joined (i.e., coupled) using three-dimensional joining members. For example, the upper traversing cross brace 118 can couple left legs 114 and 116 via joining members 180*a* and 180*d*, which are right-angle joining members. Similarly, the upper traversing cross brace 122 can couple right legs 110 and 112 via joining members 180*b* and 180*c*, as shown. Right-angle joining members 181*a* and 181*b* similarly couple the framework members of the frame body 148. Any of the joining members can also provide for attachment of a support fabric, as discussed in greater detail below.

Referring now to FIGS. 6A-6D, a joining member 600 is shown. In one embodiment, the joining member 600 can be used for the right-angle joining members 181*a-b* described above. The joining member 600 includes a body 601 that may be formed of plastic, metal, or any other material that provides resilience for coupling structural framework members, e.g., upper traversing cross-brace 118 A to legs 114 and 116. The joining member 600 includes a rectangular, column-shaped protuberance 602 and a cylindrically-shaped protuberance 603 disposed at a right angle to each other, as shown. Protuberance 602 is sized and shaped to snuggly plug into a terminal portion of a hollow, rectangular-tubular leg, e.g., leg 116, a distance h, with minimal space therebetween. Likewise, circular protuberance 603 is sized and shaped to plug into a terminal portion of a hollow, circular-tubular traversing cross brace, e.g., upper traversing cross brace 122, with minimal space therebetween.

Figure 6:
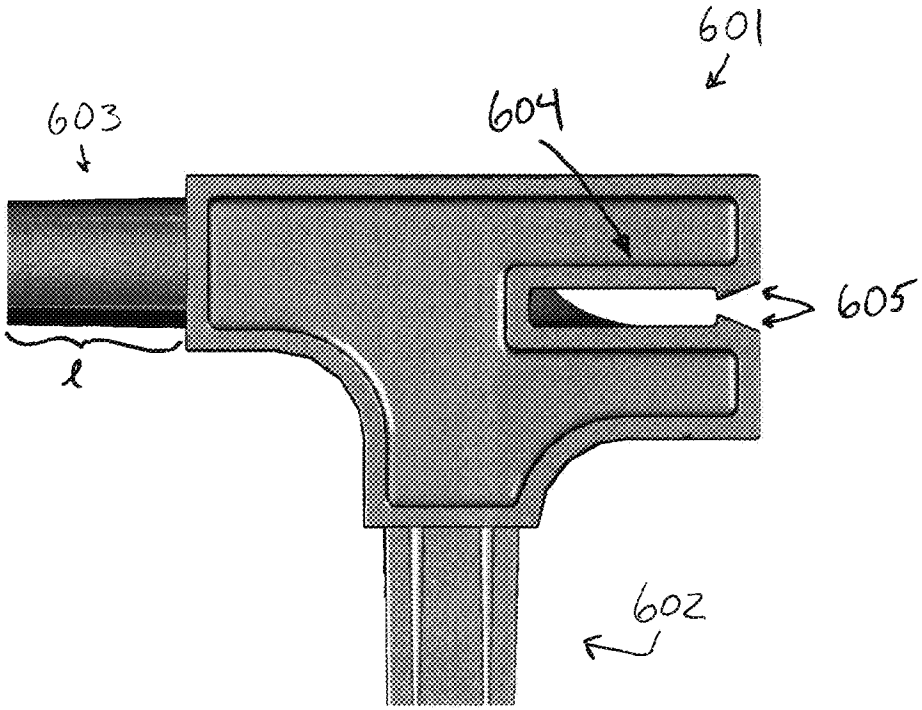
FIGS. 6A-6D shows four views of a body for receiving a support strap and joining structural members together, according to one embodiment.
Figure 6:
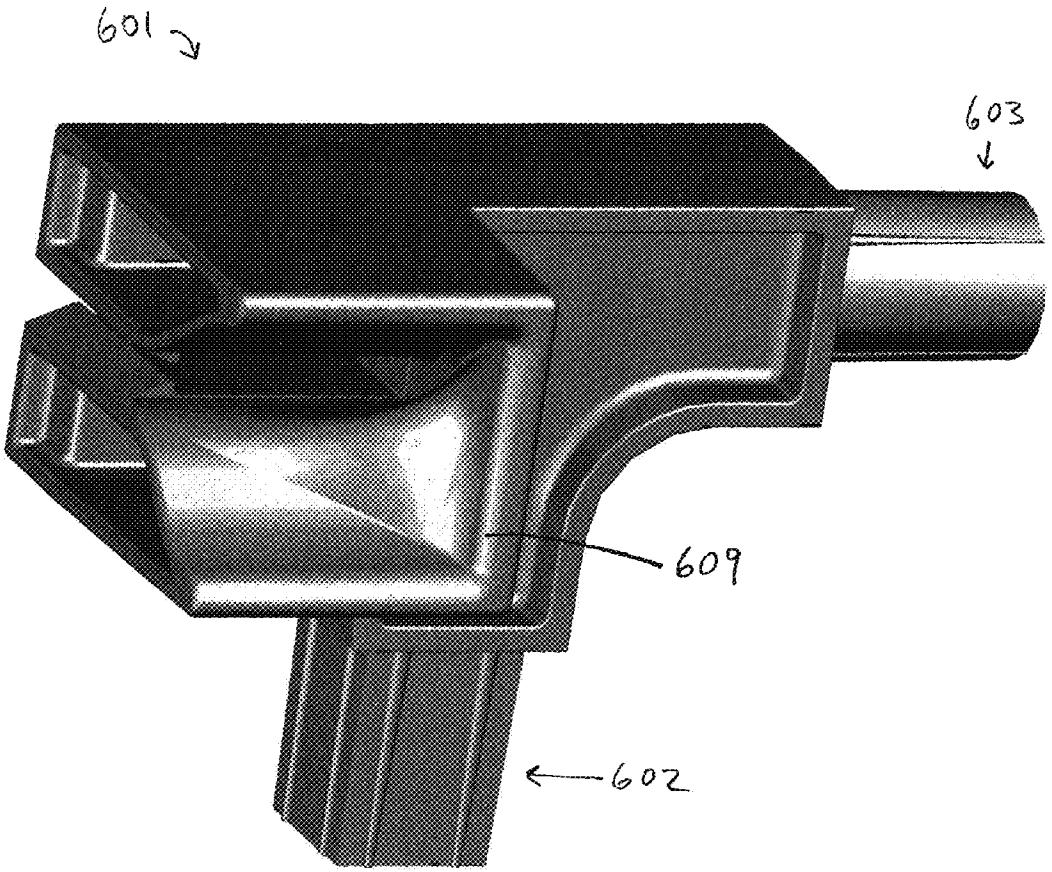

Referring to FIG. 6C, the body 601 includes a channel 604 that is sized and shaped to receive a portion of a fabric support strap (not shown in FIGS. 6A-6D for clarity). As discussed below, a fabric support strap can be integrally connected to a support fabric on which a user can place their weight, e.g., lie down or sit. In this embodiment, the channel 604 is configured to maintain the strap in a horizontal orientation and releasably secure the strap to the joining member 600. The strap can be inserted into the channel 604 through aperture 605. Aperture 605 can be sized so that it is slightly less than the thickness of the strap, so that inserting the strap into the channel requires an insertion force. Such a configuration can reduce the likelihood of the strap coming out of the channel 604 unintentionally. In one embodiment (not shown in FIG. 6), the body 601 can include cleats for securing the strap to the joining member 600; one exemplary cleat is a so-called "cam cleat," often used on boats to secure ropes and lines.

The channel 604 gradually expands in volume from a left side 610 to a right side 611 of the body 601. Flared portions 608*a*, 608*b* of the channel wall extend in opposite flaring directions to form a cusp with a bottom wall 613 and a top wall 612 of the body 601, respectively. A beveled portion 609 of the right wall 611 can allow the strap rotate to a vertical orientation and can also provide a smooth surface on which the strap can shift, e.g., during tightening and loosening of the strap. Tightening and loosening the strap, as described in greater detail below, can allow a user to apply a desired tensioning force to the support fabric.

Each of legs 110, 112, 114, and 116 can include an integral or attachable joining member 600 as shown, e.g., in FIG. 5. The joining members 600 can be fabricated with requisite symmetry for running a fabric strap around a circumferential portion of a hammock support structure (including the joining members 600), e.g., support structure 100 in FIG. 1. In one embodiment, the fabric strap can be integrally connected to a support fabric on which a user may place their weight to rest, e.g., lie or sit down.

Referring now to FIG. 7, a portable hammock 700 is shown in a folded or "closed" configuration. In one embodiment, the support structure for the portable hammock 700 can be substantially similar in design and functionality as that discussed above with respect to FIG. 1. As discussed in greater detail below, the hammock 700 can include a support material 701, which, in this example, is a nylon mesh fabric that can be attached to structural support members to support a user, e.g., in a seated or reclined position. Terminal ends of a locking strap 702 can be integrally connected to the support material 701, or, alternatively, looped around one or more support members. In the exemplary embodiment of FIG. 7, the locking strap 702 extends around left (705) and right (704) legs (similar to legs 114 and 110, respectively, in FIG. 1) and is secured by an integrated side-release buckle to hold the hammock in the closed configuration as shown.

In some embodiments, such as the embodiment of FIG. 7, a portable hammock 700 can include one or more shoulder straps 703. Shoulder straps can allow a user to transport the hammock on their person, e.g., like a backpack. The shoulder straps 703 can be integrally connected on terminal ends of the straps to a portion of the hammock structure, e.g., a support structure such as a leg or cross brace, or to a portion of the support material 701. The fabric can be reinforced for added resilience where terminal ends of the shoulder strap connect. The shoulder straps 703 can include accessories or other materials known in the art for backpacks and hiking or camping gear.

Figure 8B:
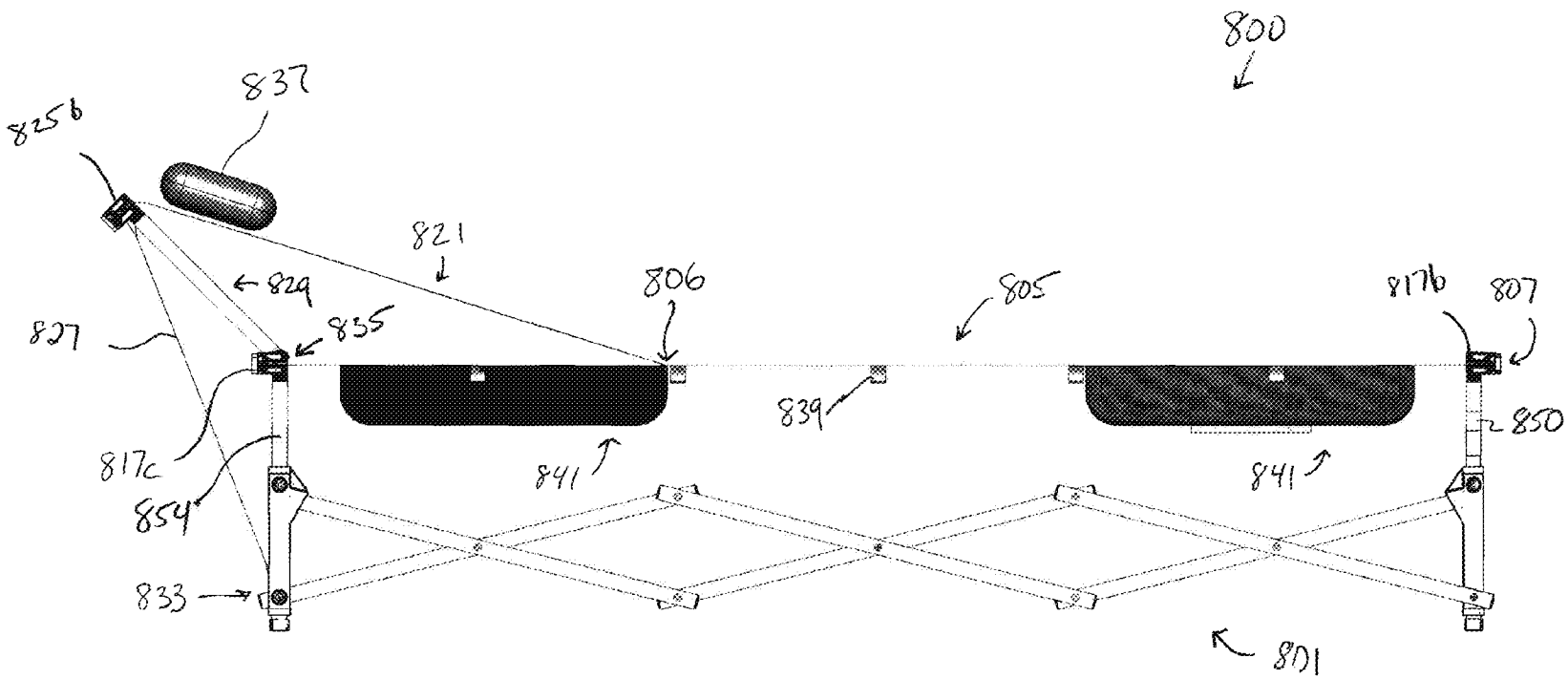

Referring now to FIGS. 8*a* and 8*b*, a collapsible hammock 800 is shown in isometric and side views, respectively. The collapsible hammock 800 includes a collapsible and extendable support structure 801 similar to the support structure 100 described with respect to FIG. 1. The support structure 801 supports a substantially planar support surface 805. The planar support surface 805 can be, for example, a flexible, yet strong material capable of supporting the weight of a user, e.g., 100 pounds, 150 pounds, 200 pounds, 250 pounds, 350 pounds, etc. In one embodiment, the planar support surface 805 is a porous, nylon mesh material providing adequate strength to support a user and also allowing for water drainage. Such a material may decrease the likelihood of mold or mildew build-up in damp environments.

A tensioning strap 807 is integrally connected to right and left peripheral sides 809, 811, respectively, of the support surface 805, and extends beyond the bottom and top end peripheral edges 813, 815, respectively, of the support surface 805. Portions of the tensioning strap 807, e.g., those that extend beyond the bottom and top end peripheral edges 813, 815 of the support surface 805, are passed through joining members 817*a-d* to support the planar support surface 805 (817*d* is not shown in FIG. 8*a* or 8*b* for figure clarity). In one embodiment, the joining members 817*a-d* are joining members 601 described with respect to FIG. 6, although the symmetry of each joining member 817*a-d* may be different to provide for a preferred arrangement of flared and beveled portions between all of the joining members 817*a-d*. In a preferred embodiment, the joining members 817*a* and 817*b* are arranged such that the beveled portions (e.g., beveled portion 609 in FIG. 6B) accommodate a vertical orientation of the strap 807 as shown in FIG. 8*a*; the same arrangement is preferred for joining members 817*c* and 817*d*.

In one embodiment, the tensioning strap 807 runs through an elongate loop of support surface material. Such an embodiment can allow the tensioning strap 807 to shift with respect to the support surface 805.

In one embodiment, the tensioning strap 807 is formed of two non-integral portions that can be fastened together. A fastener 819 can releasably join two ends of the tensioning strap 807 and furthermore provide the capability to provide a selected amount of tension in the support surface 805. The fastener 819 can be any type known in the art for releasably joining two straps, e.g., cam, over-center, or ratchet-type fasteners, buckles, and end fittings, among others. In one embodiment, the tensioning strap 807 is an integral band that runs at least the perimeter of the support surface 805, and the fastener 819 can take up slack in the band 807 to provide a selected amount of support tension in the support surface 805.

The tensioning strap 807 can be used to stiffen the overall hammock support structure 801. For example, the tensioning strap 807 in FIG. 8A runs the perimeter of the support surface 805 and also through the joining members 817*a-d* disposed on the tops of each leg 850, 852, 854 (the fourth leg is not shown in FIG. 8A) in the support structure 801. Reducing the perimeter length of the tensioning strap 807, e.g., by drawing one portion through the fastener 819 (as shown by excess strap portion 860) urges the tops of the legs toward one another, i.e., toward the midpoint of the rectangle defined by the four legs. However, this urging is met with resistance provided by the cross braces 833, 835, 856, 862 and, when locked into place in the legs, the support members (e.g., support member 130 in FIG. 1). Providing tension to the tensioning strap 807 thereby "pulls" the support structure 801 together to increase the firmness—and provide greater structural integrity of the support structure 801.

In one embodiment, the support surface 805 is integrally connected to a backrest support 821. The backrest support 821 can include secondary support strap sections 823*a*, 823*b* that extend through joining members 825*a* and 825*b*, respectively, which are part of a frame body 829 (similar to frame body 148 described with respect to FIG. 1). Joining members 825*a*, 825*b* can be similar to joining member 601 described with respect to FIG. 6.

A retaining strap 827 extends from a top cross-bar 831 of the frame body 829 to a lower traversing cross brace 833, which is similar to lower traversing cross brace 120 described in FIG. 1. The retaining strap 827 can include a fastener, similar to fastener 819, to provide adjustable tensioning of the backrest support 821. The frame body 829 in FIG. 8 can be pivotable about upper traversing cross brace 835 via c-clamps that join the frame body 829 to the upper traversing cross brace 835. In some cases, when a user reclines, the force applied to the backrest support 821 urges the frame body 829 to pivot in a clock-wise direction as viewed from the side perspective shown in FIG. 8*b*. The retaining strap 827 can selectably counteract the pivoting motion of the frame body 829, thereby providing a selectably firm surface on which the user can recline. Thus, in this manner, the position of the backrest support 821 can be adjusted via straps alone, i.e., through selected tensioning of the secondary support strap sections 823*a*, 823*b*, and the retaining strap 827), thereby balancing the force between the user's weight and the tension of the retaining strap 827. Relatedly, the frame body 829 can be held in place through opposing tension forces, i.e., the tension provided by retaining strap 827 between the top cross-bar 831 and the lower traversing cross brace 833, and the tension provided by the backrest support 821, which can be connected between the joining members 825*a* and 825*b* on the top cross-bar 831 at one end and the position where the backrest support 821 is connected to the support surface 805 at an opposite end (806 in FIG. 8*b*).

In one embodiment, the backrest support 821 can include a pillow 837. The pillow can be removable or integrally connected to the surface of the backrest support 821 by sewing or other attachment methods. In one embodiment, the pillow 837 can be inflated and deflated by the user. In one embodiment, the pillow 837 and the backrest support 821 can each include one half of a hook-and-loop fastening system (e.g., the hook-and-loop fastening system sold under the Velcro brand name), respectively, so that the pillow 837 can be removably fastened to the backrest support 821.

Figure 8C:
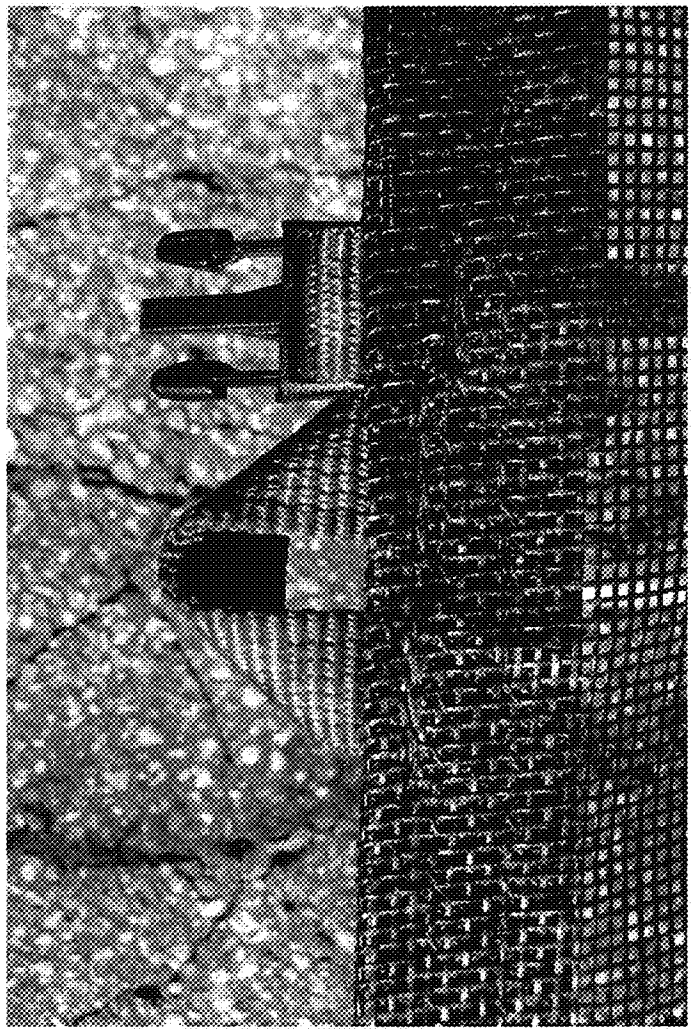
FIG. 8C shows an attachment mechanism for attaching accessory items to a collapsible hammock, according to one embodiment.

In one embodiment, the tensioning strap 807 can include fastening or attaching mechanisms for connecting accessory items, described in greater detail below, or for connecting a second collapsible hammock in a tandem configuration. The attachment mechanisms shown in FIGS. 8*a*-8*b* are loops of resilient fabric, e.g., nylon mesh, nylon webbing, or canvas fabric; however, these are only three of many attachment mechanism possibilities. Other mechanisms include, but are not limited to, hook-and-loop fasteners, so-called "side-release buckles," and many others. FIG. 8*c* is a photograph of two attachment mechanisms (a loop of nylon webbing, and a male portion of a side-release buckle), according to one embodiment. It will be understood that mechanisms for connecting accessory items can be integrally attached to a tensioning strap 807, any part of the support surface 805, or both. Likewise, mechanisms for connecting accessory items may be positioned on parts of the support structure itself, e.g., support structure 100, rather than the support surface, e.g., support surface 805.

In one embodiment, storage compartments 841 can be integrally connected to the support surface 805. The embodiment of FIGS. 8*a*-8*b* show storage compartments 841 attached to an underside of the support surface 805. The storage compartments 841 can be made of the same or similar material as the support surface 805; however, other materials can be used, depending on the intended use of the compartments. For example, a storage compartment can be formed of a waterproof material to prevent its contents from becoming wet; likewise, for food storage, a storage compartment may be formed of a resilient, air-tight material to reduce the likelihood of spoiling or attracting animals to the food.

A collapsible hammock having mechanisms for connecting accessory items provides a wide range of accessory options for the user. The following embodiments provided without limitation to convey some exemplary accessory options. It will be understood that equivalents may be substituted as well as other accessory variations that will occur to the reader.

Figure 9A:
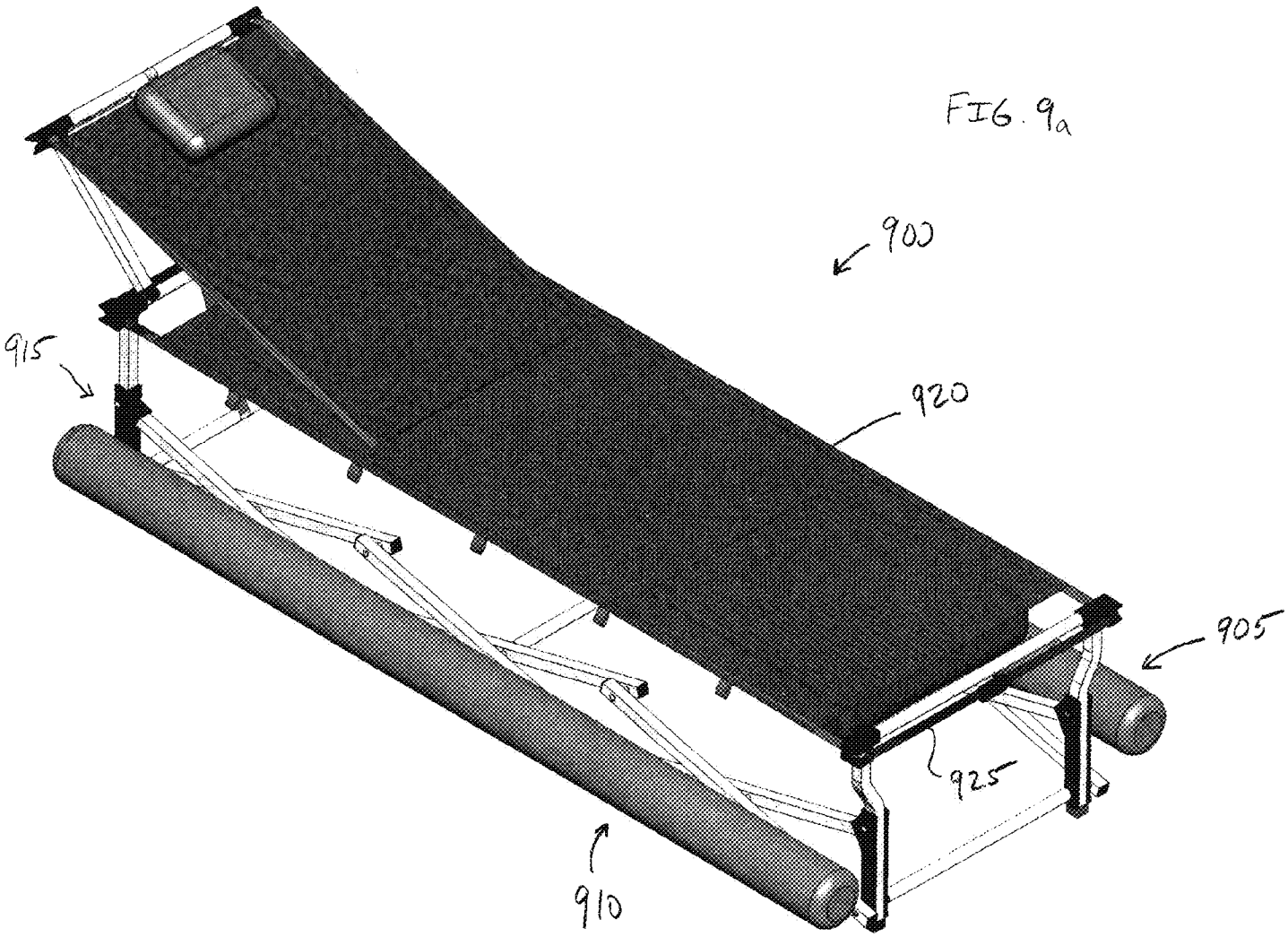
FIGS. 9A-9B show accessory members attached to a portable, collapsible hammock, according to various embodiments.
Figure 9B:
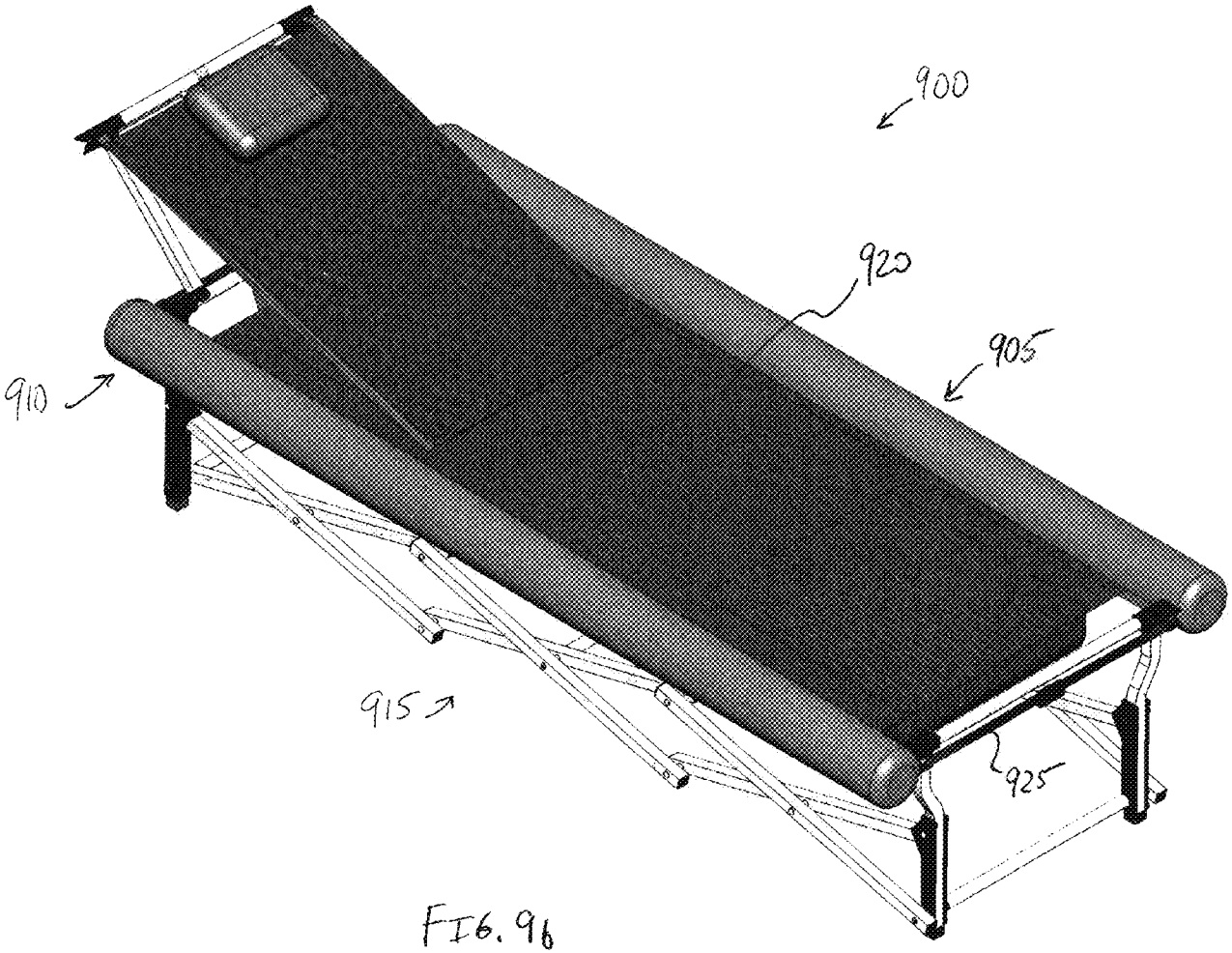

Referring now to FIGS. 9*a*-9*b*, a floatable, collapsible hammock 900 is shown. In the embodiment of FIG. 9*a*, two hollow, elongate bodies 905, 910, are connected to a portion of the support structure 915. The bodies 905, 910 can be balloon-like, in that they can be inflatable and deflatable, or they can be rigid bodies, e.g., made of plastic or other materials that provide a desired degree of buoyancy. The bodies 905, 910 can be attached to the support structure 915 by various mechanisms, such as by using fastening hardware, nuts and bolts, rivets, side-release buckles, or other means. In another embodiment, shown in FIG. 9*b*, the hollow bodies 905, 910 can be releasably attached to a planar support structure 920, or a support band 925, or both. The planar support structure 920 and the support band 925 can be similar to those described with respect to FIGS. 8*a*-8*b*.

Figure 10:
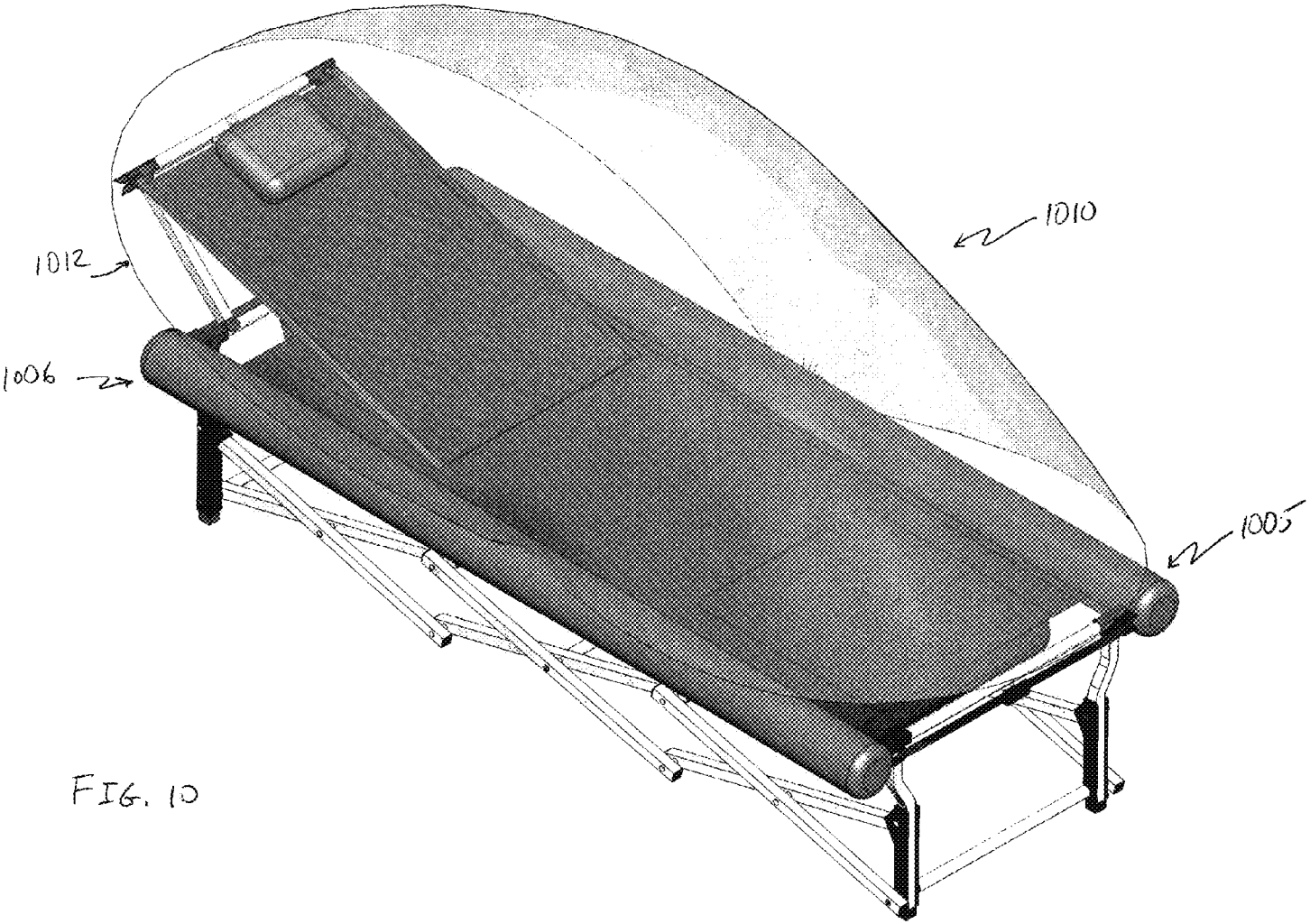
FIG. 10 shows an accessory member attached to a portable, collapsible hammock, according to one embodiment.

Referring now to FIG. 10, a collapsible hammock is shown with some exemplary accessory items. In this embodiment, the accessory items include floatation bodies 1005, 1006, and a shade body 1010. The shade body 1010 can be attached to any portion of the collapsible hammock, or any accessory member attached thereto, by methods known in the art. In this example, the shade body 1010 is attached to the planar support structure. The shade body 1010 can include one or more flexible, shape-retaining wire members 1012 configured to maintain a canopy shape when it is attached to the hammock body. The shade body 1010 can be made of selected material for its intended use. For example, the shade body 1010 can be made of a material providing a desired level of sun protection, e.g., a material providing a degree of sun-protection factor (SPF). In some embodiments, the shade body 1010 can be made of a material that provides a full or partial insect barrier. For example, the shade body 1010 can be made of so-called "mosquito netting." For advertising purposes, the shade body 1010 can include decorative indicia, including advertising indicia, trade, or brand names, logos, and the like. In some embodiments, the shade body 1010 can partially cover the user, whereas in other embodiments, the shade body can completely cover the user, when the user is resting on the hammock. The shade body can be formed from material such as, but not limited to canvas, nylon, fabric, combinations thereof, and the like.

In one embodiment, a hammock can include an anchor. The anchor can be stored on the hammock, for example, within a storage container (e.g., container 841 in FIGS. 8A and 8B) or elsewhere on the hammock. The anchor can be used, e.g., in embodiments where floatation devices are used, so that a user can maintain a position while floating. In one embodiment, an anchor can be hollow, formed of lightweight plastic material, and configured to receive sand or other material to sink the anchor to a floor of a water body.

Figure 11:
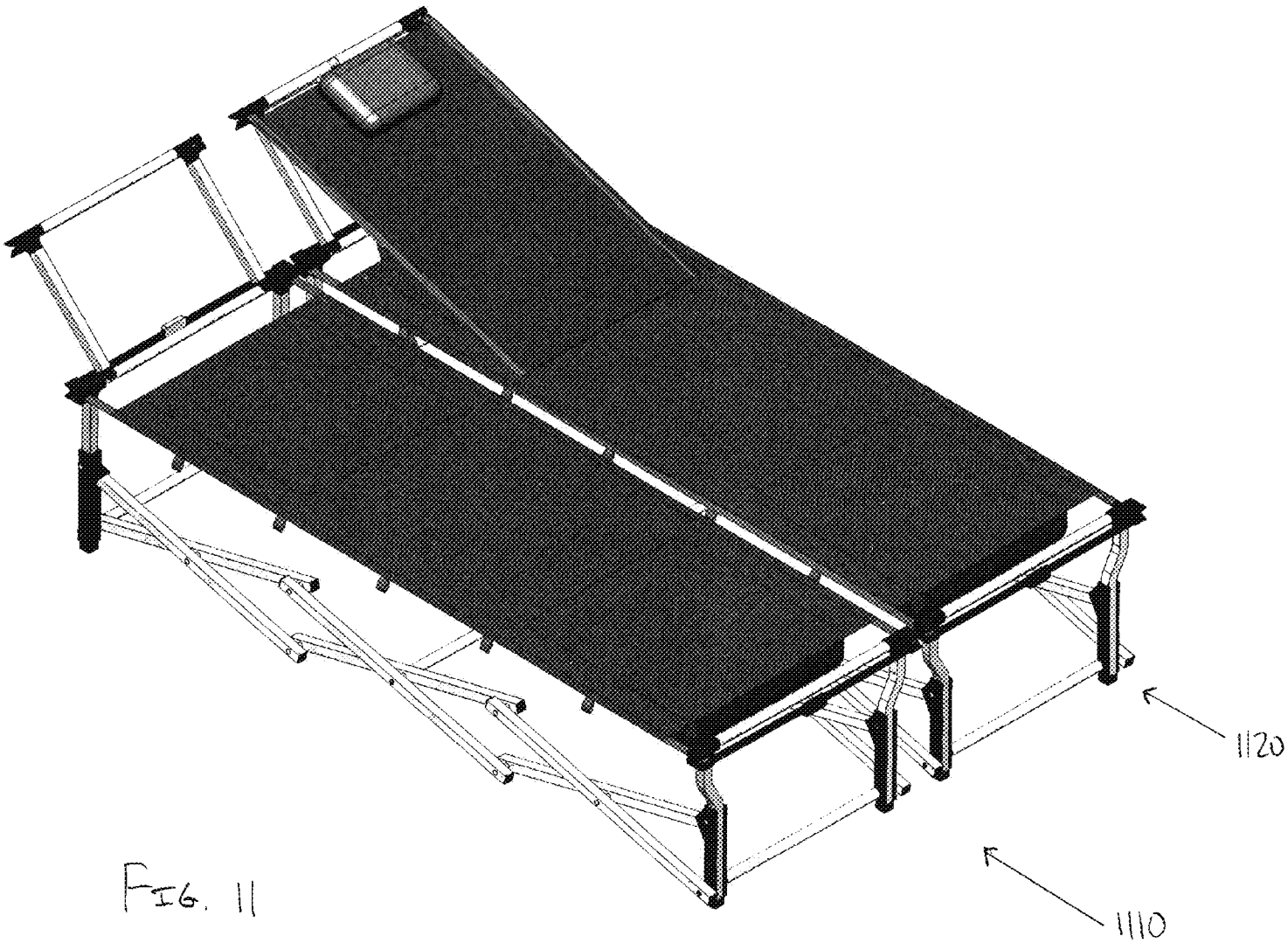
FIG. 11 shows two portable, collapsible hammocks in a tandem configuration.

Referring now to FIG. 11, two collapsible hammocks are shown in a tandem configuration. Collapsible hammocks 1110 and 1120 are similar to those described heretofore. In some embodiments, two or more collapsible hammocks can be releasably connected in a tandem configuration. In the embodiment shown in FIG. 11, the left sides of the hammocks 1110, 1120 can include one or more female halves of a side-release buckle, and the right sides of the hammocks 1110, 1120 can include one or more male halves of a side-release buckle. The respective side-release buckle halves can be positioned along a periphery of the support surface or along the periphery of a support strap so that the side-release buckle halves line up with their respective counterparts when the hammocks are positioned side-by-side, e.g., as shown in FIG. 11.

The tandem configuration of two or more collapsible hammocks has certain advantages for sleeping or resting with a partner. For example, because the substantially planar support surfaces are supported along the longitudinal sides by a flexible support strap, two people can rest comfortably together in close proximity. Additionally, the 'firmness' of the substantially planar support surface of each collapsible hammock can be adjusted by adjusting the tension of the support strap as described above. Thus, each partner can choose a resting surface with a firmness that suits their personal preference. In some embodiments, both for single and tandem collapsible hammock configurations, the backrest support can be selectably folded down, as shown for collapsible hammock 1110, providing further options for personal resting preferences.

Referring now back to FIG. 1, a method for reversibly deploying a portable hammock of the type described herein is described. FIG. 1 shows a hammock support structure 100 in the extended, deployed configuration. To fold the support structure 100 (and a substantially planar support fabric not shown in FIG. 1) into a transportable configuration, a user can pivot front (110, 112) and back (114, 116) legs about each of the respective lower traversing cross braces 120, 124, such that the terminal portion of elongate bars can be removed from the protuberant shroud that holds the terminal portions of elongate bars in place. With all four terminal portions of the elongate bars released from the respective protuberant shrouds, the front 128 and rear 126 portions of the structure 100 can be pushed together, collapsing the structure in an accordion-like fashion. As described with respect to FIG. 7, a locking strap can be used to secure the support structure 100 in the folded configuration. To deploy the hammock from the folded configuration, the aforementioned steps can be reversed.

The collapsible hammocks described herein may be manufactured to specifications for desired size, weight, length, and other measurables. In one embodiment, a collapsible hammock is approximately six (6) feet in length. In one embodiment, the substantially planar support surface is approximately 2 feet from the ground in an extended, deployed configuration. In one embodiment, a collapsible hammock can occupy a volume of approximately nine (9) cubic feet in the folded configuration. One embodiment of a collapsible hammock has undergone a finite element analysis for load bearing and was found to be able to support 350 pounds in an extended, deployed configuration. Although not shown in FIGS. 1-11, a collapsible hammock can include structural support members that allow the hammock to fold in both longitudinally and transverse directions. For example, the upper and lower traversing cross braces described with respect to FIG. 1 can include pivotally connected and crossed elongate bars to form a foldable cross-bar brace similar to support member 130 described with respect to FIG. 1.

In some embodiments, a collapsible hammock can be outfitted with holders configured to hold weaponry, such as firearms, including handguns and rifles. Such embodiments of a collapsible hammock can therefore be useful to hunters and military personnel. In the latter case, all, or portions of the collapsible hammock can include camouflage decoration so as to blend into a surrounding environment.

A number of illustrative embodiments have been described. Nevertheless, it will be understood that various modifications may be made without departing from the spirit and scope of the various embodiments presented herein. For example, while it would be impracticable to recite all available attachment means for accessories, it will be understood that a collapsible hammock can be modified or include attachment mechanisms to secure common articles. For example, a collapsible hammock can include harnesses, loops, straps, containers, recesses, pockets, clips, hooks, pouches, and similar items. Such items can allow for releasable attachment of, e.g., beverages, clothing, fishing and camping equipment, food, supplies, and other items. In one embodiment, a sleeping bag can be integrated into a user support surface (e.g., surface 805 in FIGS. 8A and 8B). In this embodiment, a sleeping bag can be stored in a storage container (e.g., container 841 in FIGS. 8A and 8B) where one or more portions of the sleeping bag can be attached to the support surface material. Accordingly, other embodiments are within the scope of the following claims.

What is claimed is:

1. A collapsible, self-supporting chaise longue, comprising:

a reversibly extensible frame system capable of supporting a first substantially planar support surface, said first substantially planar support surface being capable of supporting a user's weight when said frame system is in an extended configuration;

wherein said first substantially planar support surface comprises a tensioning strap that is capable of concurrently providing structural integrity to said frame system and allowing a user-selected amount of tension to be applied to said first substantially planar support surface when said frame system is in an extended configuration;

wherein said tensioning strap traverses a plurality of leg members of said frame system at or near an upper portion of each of said leg members.

2. The chaise longue of claim 1, wherein said reversibly extensible frame system comprises:

an assembly comprising two or more pairs of said leg members connected by one or more rotatably-coupled support member pairs that cooperatively allow said frame system to be shifted between a compact configuration and an extended configuration.

3. The chaise longue of claim 2, wherein a longitudinal stability of said frame system is at least partially provided by locking said one or more support member pairs into said extended configuration.

4. The chaise longue of claim 3, wherein said locking said one or more support member pairs into said extended configuration comprises inserting a terminal end of a first support member of a support member pair into a shroud disposed on a first one of said legs; and inserting a terminal end of a second support member into a shroud disposed on a second one of said legs.

5. The chaise longue of claim 4, wherein:

each one of said legs comprises a joining member disposed on said upper portion of said leg member, wherein said joining member is configured to receive a portion of said tensioning strap and allow shifting of said tensioning strap therethrough; and wherein tightening said tensioning strap urges said upper portions of said leg members toward one another and against an urge-resistive bracing force provided by said support member pairs, thereby providing structural integrity to said frame system.

6. The chaise longue of claim 4, wherein said second support member is part of a second support member pair.

7. The chaise longue of claim 5, wherein said joining member comprises:

a rigid body having one or more protrusions configured to securely fit into an end portion of a frame member;

a channel on a first face of said body configured to receive a portion of said tensioning strap; and a flared portion on a second face of said body, wherein said flared portion originates from said channel, and wherein said first and said second faces are substantially orthogonal.

8. The chaise longue of claim 7, wherein said rigid body comprises a first protrusion configured to be inserted into one of said leg members of said frame and a second protrusion configured to be inserted into an end portion of a cross-brace that spans two or more of said leg members.

9. The chaise longue of claim 2, further comprising a second, different substantially planar support surface capable of supporting a portion of a user's weight, wherein said second planar portion is attached to said first substantially planar support surface at one end, and to a headrest frame assembly at a second end, wherein said headrest frame assembly is rotatably coupled to a portion of said reversibly extensible frame system.

10. The chaise longue of claim 9, wherein said headrest frame assembly is rotatably coupled to a cross-brace that spans a first and a second one of said leg members.

11. The chaise longue of claim 10, wherein a headrest tensioning strap is coupled at each end to said headrest frame assembly and to a cross-brace, respectively, wherein said cross-brace is a rigid member that spans a first and second one of said leg members.

12. The chaise longue of claim 1, wherein said planar support surface comprises one or more mechanisms for attaching one or more accessories, or a second collapsible, self-supporting hammock thereto.

13. The chaise longue of claim 12, wherein said one or more accessories is one or more of: a fishing or hunting accessory, a floatation device, a shade, netting, a beverage holder, a pocket, an anchor, a pillow, or a storage container.

14. The chaise longue of claim 2, wherein a first one of said leg members comprises a jacket for coupling one of said rotatably-coupled supports to said first leg member, the jacket comprising:

a rigid body having one or more bores for inserting one or more attachment mechanisms therethrough and into said leg member to attach said jacket to said leg member; and a shroud extending from said rigid body at an angle that allows an end portion of a first support member of said rotatably-coupled support to be inserted therein when said frame is in an extended configuration;

wherein at least one of said attachment mechanisms provides for attaching a second support member of said rotatably-coupled support to said jacket.

15. The chaise longue of claim 14, further comprising a column-shaped stabilizing body protruding from said rigid body and disposed within said shroud, wherein said stabilizing body is sized and configured to be inserted into said end portion of said first support member, and wherein said stabilizing body protrudes from said rigid body at substantially the same angle as said shroud extends from said rigid body.

16. A portable cot, comprising:

a reversibly extensible frame system for supporting a fabric thereon in a cot-like configuration, comprising:

first and second support assemblies, each comprising a connected series of rotatably-coupled, x-shaped frame support members, wherein said first support assembly spans from a first leg to a second leg, and said second assembly spans from a third leg to a fourth leg, wherein each of said legs comprises an upper portion; and first and second rigid cross-braces attached to, and separately spanning from said first leg to said third leg, and from said second leg to said fourth leg to provide a semi-rigid framework having a substantially rectangular shape;

wherein said fabric further comprises a tensioning strap configured to allow a user to urge said upper portions of said first, said second, said third, and said fourth legs together against a resistive force provided by said semi-rigid framework, thereby creating a substantially rigid framework and a resting surface capable of being used as a cot.

17. The portable cot of claim 16, further comprising a shroud disposed on said upper portion of each of said first, second, third, and fourth legs that provides the capability to reversibly couple an end of said x-shaped frame support member to said leg.

18. The portable cot of claim 16, further comprising straps attached to said frame system or said fabric, or both, to allow said portable cot to be worn as a backpack.

19. The portable cot of claim 16, further comprising means for attaching accessory items or attaching two or more portable cots in a tandem configuration.

20. A portable chaise longue, comprising:

a substantially rectangular-shaped, reversibly-extensible support frame comprising a head frame and a foot frame, wherein said head frame and said foot frame comprise two legs coupled by one or more rigid cross-braces, and wherein said head frame and said foot frame are joined by at least two x-shaped supports to form a substantially-rectangular frame shape, wherein said x-shaped support comprises at least two rigid support members rotatably coupled at their longitudinal midpoints;

a first substantially planar support surface at least partially supported in a suspended configuration on at least two sides by a tensioning strap that traverses a top portion of each of said legs;

a backrest frame rotatably coupled to one of said head frame cross-braces; and a second substantially planar support surface joined along one perimeter side to said first substantially planar support surface, and along a second perimeter side to said backrest frame;

wherein providing tension to said tensioning strap causes each of said top portions of each of said legs to shift toward a midpoint of said substantially-rectangular frame when said portable chaise longue is in an extended configuration.

21. The chaise longue of claim 2, wherein said rotatably-coupled support member pairs are transversely separated by a spacer.

22. The chaise longue of claim 7, wherein said channel of said joining member has a width less than a thickness of said tensioning strap for frictionally resisting a tensioning strap disengagement force.

23. The chaise longue of claim 7, further comprising a cleat for securing said tensioning strap to said joining member.

24. The chaise longue of claim 1, wherein said first substantially planar support surface is comprised of a nylon mesh material.

25. The chaise longue of claim 1, wherein said first substantially planar support surface comprises an elongate loop disposed on at least one side of its perimeter that is configured to allow said tensioning strap to shift therethrough.

26. The chaise longue of claim 1, wherein said tensioning strap is comprised of two coupled, non-integral tensioning strap portions.

27. The chaise longue of claim 9, wherein said portion of said reversibly extensible frame system is a lower traversing cross brace, and a retaining strap spans between said headrest frame assembly and said lower traversing cross brace to provide adjustable tensioning of said second, different substantially planar support surface.

28. The chaise longue of claim 1, further comprising at least one fastening mechanism configured to allow coupling of a second of said chaise longues in a tandem configuration.

29. The chaise longue of claim 28, wherein said fastening mechanism is a loop of resilient fabric, a hook-and-loop type fastener, or a side-release buckle.

30. The chaise longue of claim 1, further comprising a waterproof storage compartment integrally connected to said first substantially planar support surface.

* * * * *